United States Patent [19]

Yokoi et al.

[11] Patent Number: 4,966,358

[45] Date of Patent: Oct. 30, 1990

[54] APPARATUS FOR FEEDING RECORDING MEDIUM, HAVING MEANS FOR EASY HANDLING OF JAMMING TROUBLE

[75] Inventors: Takeshi Yokoi, Kakamigahara; Hiroyasu Kuragairi, Chita; Shigeo Nakamura; Tamotu Kato, both of Nagoya; Kazuo Umemura; Hiroshi Yamanaka, both of Nagoya, all of Japan

[73] Assignee: Brother Kogyo Kabushiki Kaisha, Japan

[21] Appl. No.: 222,043

[22] Filed: Jul. 20, 1988

[30] Foreign Application Priority Data

Jul. 24, 1987 [JP] Japan ..... 62-185963
Nov. 20, 1987 [JP] Japan ..... 62-178218[U]

[51] Int. Cl.[5] ..... B65H 3/30

[52] U.S. Cl. ..... 271/10; 271/9; 271/22; 271/117; 271/127

[58] Field of Search ..... 271/9, 10, 21, 22, 127, 271/121, 117, 162, 164, 170, 167

[56] References Cited

U.S. PATENT DOCUMENTS 3,110,489 11/1963 Zahradnik ..... 271/22
3,601,389 8/1971 Kramer ..... 271/170
3,652,083 3/1972 Bosshardt ..... 271/170 X
4,529,189 7/1985 Konishi et al. .
4,623,138 11/1986 Sakamaki et al. .
4,635,919 1/1987 Habich ..... 271/22
4,772,007 9/1988 Kashimura .

FOREIGN PATENT DOCUMENTS 8625123 1/1987 Fed. Rep. of Germany .
31830 2/1983 Japan ..... 271/167
59-35470 10/1984 Japan .
61-226458 10/1986 Japan .
62-116426 5/1987 Japan .
244823 10/1987 Japan .
2055768 3/1981 United Kingdom .

OTHER PUBLICATIONS

European Search Report No. 88306831.4–, dated Apr. 5, 1990.

*Primary Examiner*—Richard A. Schacher
*Attorney, Agent, or Firm*—Oliff & Berridge

[57] ABSTRACT

A feeding apparatus for a printer wherein an uppermost sheet of a sheet stack placed on a support member is delivered by a feed roll in contact with the uppermost sheet, through a clearance formed between a presser member which engages the upper surface of the uppermost sheet, and an elastic member which is disposed adjacent to the presser member for abutting contact with the edges of the sheet stack. The apparatus includes a support mechanism for supporting the presser and elastic members such that the two members are movable toward and away from each other, and a biasing spring for biasing the two members toward each other. The relative position of the presser and elastic members and the amount of the clearance therebetween during a normal sheet feeding operation are determined by a stopper device. In the event of jamming of a sheet between the presser and elastic members, the two members may be moved away from each other against a biasing action of the spring, whereby the jammed sheet may be easily removed. Also disclosed are various other devices for facilitating the removal of the jammed sheet, such as a device for positively enlarging the clearance between the presser and elastic member, and a device for moving sheet advancing rolls away from each other.

24 Claims, 12 Drawing Sheets

FIG. 5
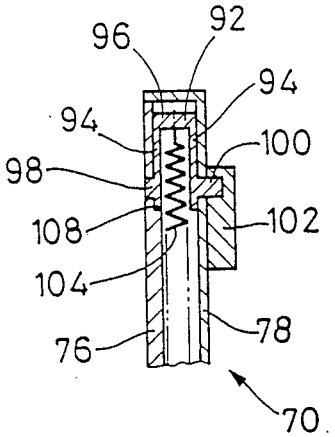
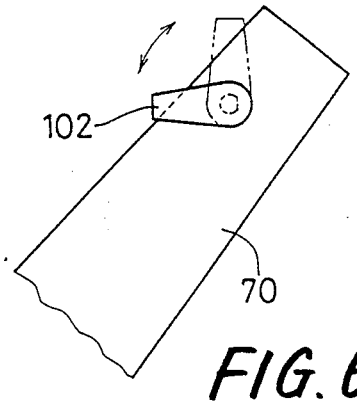
FIG. 6
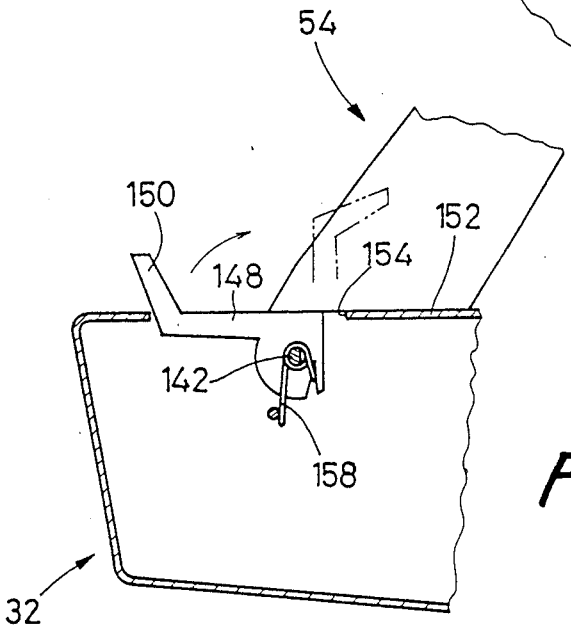
FIG. 8

APPARATUS FOR FEEDING RECORDING MEDIUM, HAVING MEANS FOR EASY HANDLING OF JAMMING TROUBLE

BACKGROUND OF THE INVENTION

1. Field of the Invention

The present invention relates generally to an apparatus for feeding sheets of paper or other types of recording media one after another from a paper stacker to a printer, such that an uppermost one of a stack of media is delivered by a feed roll or rolls in contact with the uppermost media of the stack. More particularly, the invention is concerned with techniques for easy handling of jamming troubles of the recording media in such a feeding apparatus wherein the uppermost media of the stack is delivered through a clearance between a presser member and an elastic member of the paper stacker.

2. Discussion of the Prior Art

A commonly known type of the feeding apparatus indicated above includes (a) a presser member engageable with a leading portion of the upper surface of an uppermost sheet of a stack of cut sheets placed on a sheet support member, to thereby press the uppermost sheet toward the sheet support member, (b) an elastic member disposed adjacent to the presser member for engagement with leading edges of the cut sheets, and elastically deformable in a sheet feeding direction toward a printer, according to a force of contact between the elastic member and the leading edges of the sheets, and (c) a feed roll engageable with the upper surface of the uppermost sheet, at a position rearwardly of the presser member, for exerting an advancing force on the uppermost sheet and thereby delivering the uppermost sheet toward the printer, through a clearance formed between the elastic member and the presser member due to elastic deformation or deflection of the elastic member.

In a feeding apparatus of such a type as indicated above, the cut sheets may be delivered in two different manners, depending upon the stiffness of the cut sheets to be delivered. Described more specifically, where the sheets are comparatively stiff, the sheets are delivered while being passed through the clearance between the presser and elastic members, which is formed due to elastic deformation of the elastic member by the abutting contact of the leading edges of the sheets with the elastic member, as indicated above. Where the sheets are comparatively soft, on the other hand, the uppermost sheet of the sheet stack is upwardly curved at a portion thereof between the feed roll and the presser member, and the leading end portion of the uppermost sheet abutting on the elastic member leaps over the presser member due to a resilient force created by the upward curving of the sheet, whereby the uppermost sheet clears the presser and elastic members.

In the known feeding apparatus discussed above, the presser member and the elastic member are disposed such that there exists a predetermined small amount of nominal gap or clearance between the two members in the direction of thickness of the sheet to be delivered from the sheet support member. In this arrangement, the sheets may be jammed while being delivered through the above-indicated clearance, for some reason or other, for example, due to passage of the two or more sheets through the clearance at one time, due to deviation of the sheet off the nominal path that includes the clearance. In this event, there arises a need of pulling the jammed sheet or sheets backward in the direction opposite to the sheet feeding direction, through the clearance between the presser and elastic members. Consequently, the elastic member is elastically deformed or deflected in the backward direction, i.e., in the direction opposite to the direction in which the elastic member is normally deformed during a normal sheet feeding operation. As a result, the sheet may be heavily pinched between the presser and elastic members, and may be torn or otherwise damaged. Thus, the jammed sheet may not be suitably removed from the feeding apparatus, and the removed sheet cannot be reused. Further, the elastic member may undergo an excessive amount of elastic deformation beyond its elasticity limit, causing unfavorable permanent plastic deformation, which prevents the elastic member from normally functioning to deliver the sheets.

A known feeding apparatus of the type indicated above may or may not include a pair of advancing rolls disposed ahead of the presser and elastic members, so that the sheet delivered through the clearance therebetween is advanced by the advancing rolls toward a printing mechanism of the printer. Where the apparatus is equipped with such a sheet advancing mechanism, the leading end portion of the sheet which is jammed between the presser and elastic members may be pinched between the advancing rolls. To remove the jammed sheet, the sheet must be pulled frontwardly in the sheet feeding direction or rearwardly in the direction opposite to the feeding direction. In either case, the sheet is subjected to a considerably large pull force, due to the contact of the jammed sheet with the advancing rolls at rest, which are connected to a suitable drive mechanism. This makes worse the situation in which the jammed sheet is removed.

Another problem is encountered in the feeding apparatus wherein the pair of advancing rolls is provided for advancing the sheets delivered by the feed roll from the stacker. That is, the positions of the advancing rolls in the direction perpendicular to the sheet feeding direction cannot be easily adjusted to the width of the sheets, since the advancing rolls are held in pressed rolling contact with each other. Further, once the paper stacker is loaded with a stack of sheets, the feed roll cannot be easily moved in the direction of width of the sheets, since the feed roll is held in pressed contact with the uppermost sheet of the stack.

Regarding the removal of a jammed sheet, it is also noted that the jammed sheet remains in contact with the feed roll. This also makes it difficult to remove the jammed sheet, since the feed roll is connected to a drive mechanism.

When the feeding apparatus operates to deliver recording media having folded portions, such as envelopes with gummed edges, the recording medium may be easily jammed during its passage through the clearance between the presser and elastic members, due to the folded portion or gummed edge which is easily caught by the edge of the presser member, particularly if the pressure member has a relatively small thickness.

SUMMARY OF THE INVENTION

It is therefore a first object of the present invention to provide a feeding apparatus wherein a sheet jammed between the presser member and the elastic member of a paper stacker may be easily removed.

A second object of the invention is to provide such a feeding apparatus wherein a jammed sheet may be easily removed even where the sheet is pinched between advancing rolls disposed ahead of the presser and elastic members.

A third object of the invention is to provide such a feeding apparatus wherein the advancing rolls and the feed roll may be easily moved in the direction of width of the sheets.

A fourth object of the invention is to provide such a feeding apparatus wherein a jammed sheet may be easily removed even where the jammed sheet remains in contact with the feed roll.

A fifth object of the invention is to provide such a feeding apparatus which is capable of feeding recording media which have folded or gummed portions, such as envelopes, without a jamming trouble.

The first object may be achieved according to one aspect of the present invention, which provides a feeding apparatus for feeding cut sheets one after another to a printer in a feeding direction, comprising: a presser member engageable with an upper surface of an uppermost sheet of a stack of the cut sheets placed on a sheet support member, to thereby press the uppermost sheet toward the support member; an elastic member disposed adjacent to the presser member and engageable with leading edges of the cut sheets, the elastic member being elastically deformed in the feeding direction according to a force of contact between the elastic member and the leading edges; a feed roll engageable with the upper surface of the uppermost sheet, at a position rearwardly of the presser member, for exerting an advancing force on the uppermost sheet and thereby delivering the uppermost sheet toward the printer, through a clearance formed between the elastic member and the presser member due to elastic deformation of the elastic member; a support mechanism for supporting the presser member and the elastic member such that the presser and elastic members are movable toward and away from each other; biasing means for biasing the presser and elastic members toward each other; and stop means for defining a maximum relative movement of the presser and elastic members toward each other.

In the feeding apparatus of the present invention constructed as described above, the presser and elastic members which are supported movably toward and away from each other and biased toward each other cooperate with each other to deliver the cut sheets one after another, one at a time, by rotation of the feed roll in contact with the uppermost sheet of the stack placed on the sheet support member. In the event that the uppermost sheet is jammed between the presser and elastic members and is manually pulled in the rearward direction, the presser and elastic members are permitted to move in opposite directions away from each other against the biasing force of the biasing means. Thus, the jammed sheet can be comparatively easily removed, with a reduced force of pinching of the jammed sheet by the presser and elastic members, whereby otherwise possible tearing or other damages of the sheet, and plastic deformation of the elastic member may be suitably avoided.

One form of the feeding apparatus of the invention described above may further comprise a clearance enlarging mechanism for positively enlarging the clearance between the presser and elastic members, by moving the presser and elastic members away from each other against the biasing force of the biasing means, and/or a contact release mechanism for moving the feed roll and the sheet support member away from each other and thereby releasing an operating condition in which the feed roll and the upper surface of the uppermost sheet are engageable with each other. The clearance enlarging mechanism and/or the contact release mechanism further facilitate(s) the removal of the jammed sheet by pulling it in the frontward or rearward direction along the feeding path of the sheet. Preferably, an operator's controlled operating device is provided for operating both the clearance enlarging mechanism and the contact release mechanism, if the two mechanisms are provided.

Where the clearance enlarging mechanism and the contact release mechanism are controlled by the operator's controlled operating device, the operator's controlled operating device may include an operating member which is movable from an original position thereof to a first and a second position thereof. In this case, a movement of the operating member from the original position to the first position causes the contact release mechanism to operate while maintaining the clearance enlarging mechanism inoperative, and a movement of the operating member to the second position causes both of the clearance enlarging and contact release mechanisms to operate.

In another form of the feeding apparatus, the support mechanism for supporting the presser member and the elastic member includes a link mechanism comprising a first link plate movable together with the presser member, a second link plate movable together with the elastic member, and a floating shaft which extends through the first and second link plates and thereby connects the first and second link plates pivotally thereabout in a plane parallel to planes of the link plates. The floating shaft is movable together with the link plates in the plane, and the link mechanism further comprises a stationary shaft which is supported by a stationary member such that the stationary shaft is immovable in a direction intersecting an axis thereof and such that the first and second link plates are pivotable about the axis of the stationary shaft. In this case, the biasing means includes first biasing means connected to the first and second link plates for biasing the first and second link plates in a direction that causes the presser and elastic members to move toward each other, and second biasing means connected to the stationary member and one of said first and second link plates for biasing the first and second link plates in a direction that causes the presser member to move toward the upper surface of the uppermost sheet. On the other hand, the stop means indicated above includes first and second stoppers provided on the first and second link plates, respectively, such that the first and second stoppers are movable together with the first and second link plates, for defining the maximum relative movement of the presser and elastic members toward each other. In the instant form of the invention, the feeding apparatus further comprise third and fourth stoppers which are supported by the stationary member. The third stopper is abuttable on a fifth stopper provided on the first link plate, to thereby define a maximum movement of the second link plate about the stationary shaft against the biasing force of the second biasing means. The fourth stopper is abuttable on a sixth stopper provided on the second link plate, to thereby define a maximum movement of the first link plate about the floating shaft against the biasing force of the first biasing means, after the maximum movement of the second link plate is established by abutting contact of the third and fifth stoppers.

The second object indicated above may be attained according to a second aspect of the present invention, which provides a feeding apparatus for feeding cut sheets one after another to a printer in a feeding direction, comprising: a presser member engageable with an upper surface of an uppermost sheet of a stack of the cut sheets placed on a sheet support member to thereby press the uppermost sheet toward the support member; an elastic member disposed adjacent to the presser member and engageable with leading edges of the cut sheets, the elastic member being elastically deformed in the feeding direction according to a force of contact between the elastic member and the leading edges; a feed roll engageable with the upper surface of the uppermost sheet, at a position rearwardly of the presser member, for exerting an advancing force on the uppermost sheet and thereby delivering the uppermost sheet toward the printer through a clearance formed between the elastic member and the presser member due to elastic deformation of the elastic member; a clearance enlarging mechanism for enlarging the clearance by moving the presser and elastic members away from each other; a pair of advancing rolls for advancing the uppermost sheet delivered through the clearance, toward the printer, in contact with the upper surface and a lower surface of the uppermost sheet; and pressure-nip release mechanism for moving the pair of advancing rolls away from each other and thereby releasing a condition in which the pair of advancing rolls maintain a pressure nip therebetween through which the uppermost sheet passes with the upper and lower surfaces thereof in contact with the pair of advancing rolls.

In the feeding apparatus described above, the clearance enlarging mechanism is operated to positively enlarge the clearance between the presser and elastic members, whereby the jammed sheet may be easily removed with a reduced force of contact of the jammed sheet with the presser and elastic members. Even if the jammed sheet is pinched between the pair of advancing rolls, the sheet may be readily pulled from between the advancing rolls by operating the pressure-nip release mechanism.

In one form of the feeding apparatus described above, the clearance enlarging mechanism includes a link mechanism, first and second biasing means, and first, second, third, fourth, fifth and sixth stoppers. The link mechanism comprises a first link plate movable together with the presser member, a second link plate movable together with the elastic member, and a floating shaft which extends through the first and second link plates and thereby connects the first and second link plates pivotally thereabout in a plane parallel to planes of the link plates. The floating shaft is movable together with the link plates in the plane. The link mechanism further comprises a stationary shaft which is supported by a stationary member such that the stationary shaft is immovable in a direction intersecting an axis thereof and such that the first and second link plates are pivotable about the axis of the stationary shaft. The first biasing means is connected to the first and second link plates for biasing the first and second link plates in a direction that causes the presser and elastic members to move toward each other, while the second biasing means is connected to the stationary member and one of the first and second link plates biasing the first and second link plates in a direction that causes the presser member to move toward the upper surface of the uppermost sheet. The first and second stoppers are provided on the first and second link plates, respectively, which are movable together with the first and second link plates, for defining a maximum relative movement of the preser and elastic members toward each other. The third and fourth stoppers are supported by the stationary member, and the fifth and sixth stoppers are provided on the first and second link plates, respectively. The third stopper is abuttable on the fifth stopper to thereby define a maximum movement of the second link plate about the stationary shaft against the biasing force of the second biasing means, and the fourth stopper is abuttable on the sixth stopper to thereby define a maximum movement of the first link plate about the floating shaft against the biasing force of the first biasing means, after the maximum movement of the second link plate is established by abutting contact of the third and fixth stoppers.

In another form of the same feeding apparatus according to the second aspect of the invention, the pressure-nip release mechanism includes a cam-type pressure-nip release mechanism which comprises a cam having an operating surface, and at least one of the pair of advancing rolls is formed with an extension shaft which extends coaxially with the above-indicated at least one of the advancing rolls. The cam of the cam-type pressure-nip release mechanism is movable such that the operating surface contacts the extension shaft of the at least one advancing roll, to thereby enlarge the clearance between the pair of advancing rolls.

In a further form of the same feeding apparatus, the pressure-nip release mechanism includes a sheet-spring type pressure-nip release mechanism which comprises a generally planar spring member as a principal component thereof. The spring member has an intermediate portion at which the spring member is pivotally supported by a stationary shaft which is supported by a stationary member. One of opposite end portions of the spring member engages one of the pair of feed rolls, and the other end portion engages a cam provided on the stationary member. The cam has an operative position in which the spring member urging the above-indicated one advancing roll against the other advancing roll, and an inoperative position in which the the spring member maintains the above one advancing roll in non-contact relation with the other advancing roll.

In a still further form of the feeding apparatus according to the second aspect of the invention, an operator's controlled operating device is provided for operating both of the clearance enlarging mechanism and the pressure-nip release mechanism. In this case, the apparatus may further comprise a contact release mechanism for moving the sheet support member and the feed roll away from each other and thereby releasing an operating condition in which the feed roll and the upper surface of the uppermost sheet are engageable with each other. In this instance, the operator's controlled operating device may be a three-mechanism operating device which operate all of three mechanisms, that is, the contact release mechanism, the clearance enlarging mechanism, and the pressure-nip release mechanism.

According to a third aspect of the present invention, the third and fourth objects indicated above may be accomplished. Namely, the feeding apparatus comprises the presser member, elastic member and feed roll which have been described above, and further comprises: a contact release mechanism for moving the feed roll and the medium support member away from each other and thereby releasing an operating condition in which the feed roll and the upper surface of the uppermost sheet are engageable with each other; a pair of advancing rolls for advancing the uppermost sheet delivered through the clearance, toward the printer, in contact with the upper surface and a lower surface of the uppermost sheet; a pressure-nip release mechanism for moving the pair of advancing rolls away from each other and thereby releasing a condition in which the pair of advancing rolls maintain a pressure nip therebetween through which the uppermost sheet passes with the upper and lower surfaces thereof in contact with the pair of advancing rolls; and an operator's controlled operating device for operating both of the contact release mechanism and the pressure-nip release mechanism.

In the feeding apparatus described above, the feed roll and the advancing rolls may be readily moved in the direction perpendicular to the feeding direction, by operation of the operator's controlled operating device, to activate the contact release mechanism and the pressure-nip release mechanism, through the operator's controlled operating device. Namely, the movement of the feed roll in the direction away from the sheet support member reduces the contact force between the feed roll and the uppermost sheet of the sheet stack, thereby facilitating the movement of the feed roll in the direction of width of the sheets to be delivered. Further, the movement of the advancing rolls away from each other certainly enables the advancing rolls to be moved in the direction of width of the sheets. Thus, the instant arrangement permits easy adjustment of the positions of the feed roll and advancing rolls to the specific width of the sheets.

Moreover, the movement of the feed roll away from the sheet support member facilitates the removal of the jammed sheet which remains in contact with the feed roll.

The pressure-nip release mechanism provided in the feeding apparatus according to the third aspect of the invention described just above may be either the cam-type mechanism or the sheet-spring type mechanism, both of which have been described above, with respect to the second aspect of the invention. The contact release mechanism may include a cam-type contact release mechanism which includes a cam for moving the feed roll and the medium support member away from each other. In this instance, the operator's controlled operating device may be a cam-type operating device which operates the pressure-nip release mechanism by utilizing a movement of the cam of the cam-type contact release mechanism.

The fifth object of the present invention may be achieved according to a fifth aspect of the invention, which provides a feeding apparatus for feeding recording media one after another to a printer in a feeding direction, comprising: a presser member engageable with an upper surface of an uppermost recording medium of a stack of the recording media superposed on each other on a medium support member, to thereby press the uppermost recording medium toward the medium support member; an elastic member disposed adjacent to the presser member and engageable with leading edges of the recording media, the elastic member being elastically deformed in the feeding direction according to a force of contact between the elastic member and the leading edges of the recording media; and a feed roll engageable with the upper surface of the uppermost recording medium, at a position rearwardly of the presser member, for exerting an advancing force on the uppermost recording medium and thereby delivering the uppermost recording medium toward the printer, through a clearance formed between the elastic member and the presser member due to elastic deformation of the elastic member. In the present appratus, the presser member has a lower surface which includes a contact area which is engageable with the upper surface of the uppermost recording medium, and a guide area which extends from the contact area rearwardly in a direction opposite to the feeding direction. The guide area is inclined such that a distance between the upper surface of the uppermost recording medium and the guide area increases with a distance between the guide area and the contact area in the direction opposite to the feeding direction.

In the feeding apparatus constructed as described above, the recording medium can be suitably delivered through the clearance between the presser member and the elastic member, even if the recording medium has a folded portion such as a gummed portion of an envelope. That is, the rearwardly obliquely inclined guide area of the presser member first contacts the edge of the folded portion, so as to smoothly guide the folded portion into contact with the contact area of the presser member, whereby the folded portion will not be caught by the presser member. In this connection, it is required that the height of the inclined guide area of the presser member as measured in the direction of thickness of the recording medium be larger than the thickness of the folded portion of the medium. Even if the presser member has a sufficiently larger thickness than the thickness of the folded portion of the recording medium, the folded portion may be caught by the presser member, unless the presser member has the inclined guide surface.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which:

FIG. 5 is a cross sectional view taken along line V—V of FIG. 4;

FIG. 6 is a side elevational view of a push-up force selector lever and related components of the feeding apparatus;

FIG. 8 is a fragmentary side elevational view partly in cross section of a sheet loading lever and related components of the feeding apparatus;

DETAILED DESCRIPTION OF THE PREFERRED EMBODIMENTS

Figure 1:
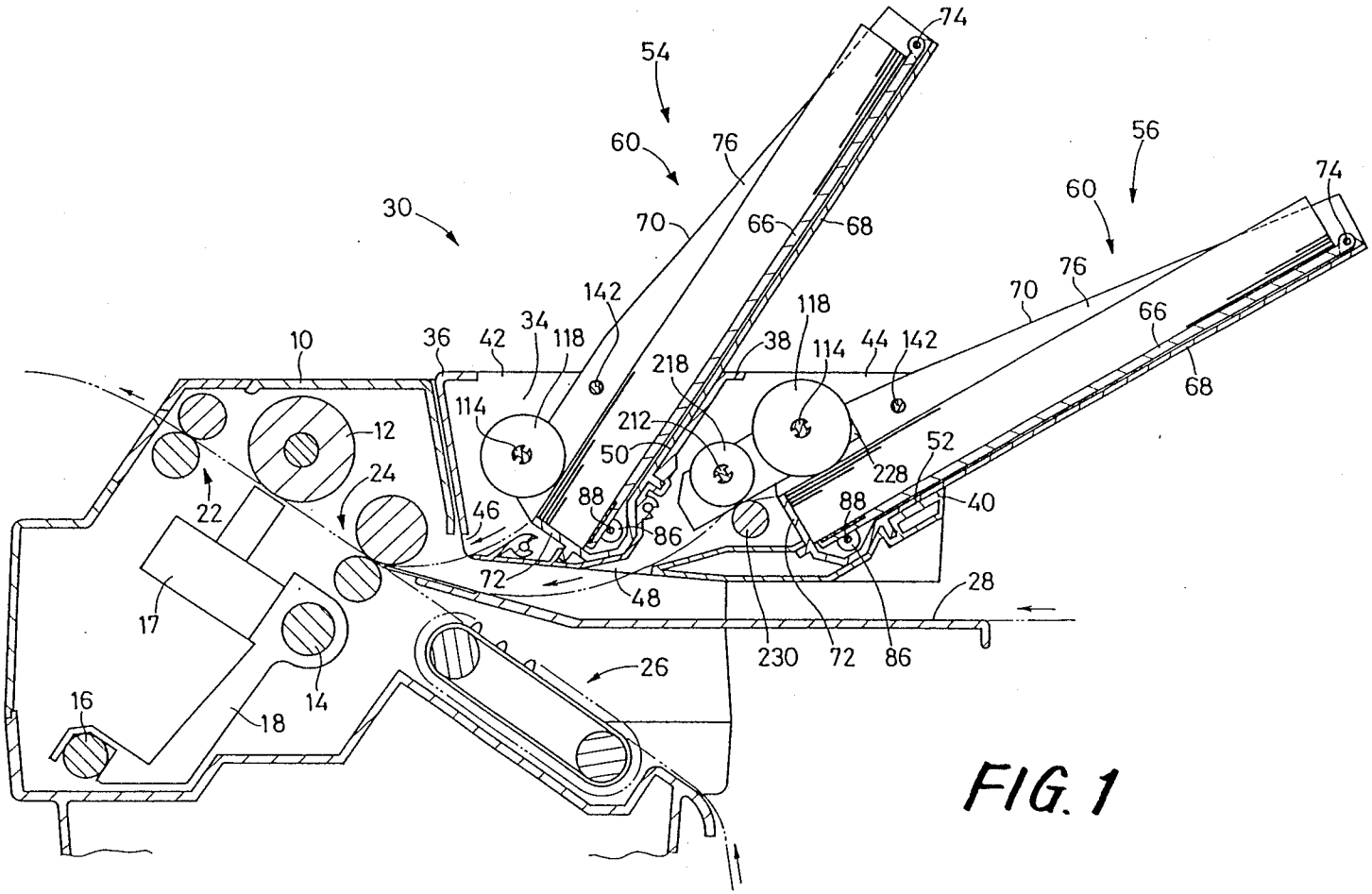
FIG. 1 is a side elevational view in cross section of a printer equipped with one embodiment of a sheet feeding apparatus of the present invention.

The sheet feeding apparatus according to the present invention is used in combination with a known printer. Referring first to FIG. 1, the printer equipped with one embodiment of the sheet feeding apparatus of the invention will be described briefly. In the figure, reference numeral 10 denotes a printer housing having a generally elongate structure which extends in a lateral direction perpendicular to the plane of the figure. Within this housing, a platen 12 and two guide bars 14, 16 are disposed in the lateral direction, i.e., along the length of the elongate structure of the housing 10. The platen 12 is supported rotatably about its axis. A print head 17 is mounted on a carriage 18 such that the print head 17 faces the platen 12. The carriage 18 is supported by the guide bars 14, 16 slidably along the platen 12. On opposite sides of the axis of rotation of the platen 12, there are disposed a first pair of feed rollers 22, and a second pair of feed rollers 24. These feed rollers 22, 24 and the platen 12 are operatively connected to an electric motor via a suitable gearing arrangement, so that the rollers 22, 24 and platen 12 are rotated by the motor to advance a recording medium in a feeding direction from the downstream feed rollers 24 toward the upstream feed rollers 22, through a gap between the platen 12 and the print head 17. In FIG. 1, reference numeral 26 designates a pin tractor for introducing a recording medium in the form of a continuous web, from the outside of the printer to the downstream pair of feed rollers 24. Further, reference numeral 28 designates a manual sheet insertion guide 28 for directing a manually inserted cut sheet to the downstream feed rollers 24.

In FIG. 1, reference numeral 30 generally indicates the sheet feeding apparatus constructed according to one embodiment of the invention, which will be simply referred to as "feeding apparatus". This feeding apparatus 30 is removably attached to the printer. Like the printer's housing 10, the feeding apparatus 30 has a generally elongate structure which extends in the lateral direction perpendicular to the plane of FIG. 1. Described more specifically referring further to FIG. 2, the apparatus 30 includes a pair of box-like frames, that is, left and right frames 32, 34 disposed at the opposite longitudinal ends of the apparatus. Between these two frames 32, 34, there are arranged a front frame 36, a center frame 38 and a rear frame 40 which extend in the longitudinal direction of the feeding apparatus 30, i.e., in the lateral direction of the printer. The front, center and rear frames 36, 38, 40 are spaced apart from each other in a sheet feeding direction perpendicular to the lateral direction of the printer, whereby a first opening 42 and a rear opening 44 are formed in respective front and rear portions of the top of the apparatus, while a third and a fourth opening 46, 48 are formed in respective front and rear portions of the bottom of the apparatus. These openings 42, 44, 46, 48 extend in the longitudinal direction of the apparatus 30.

Figure 2:
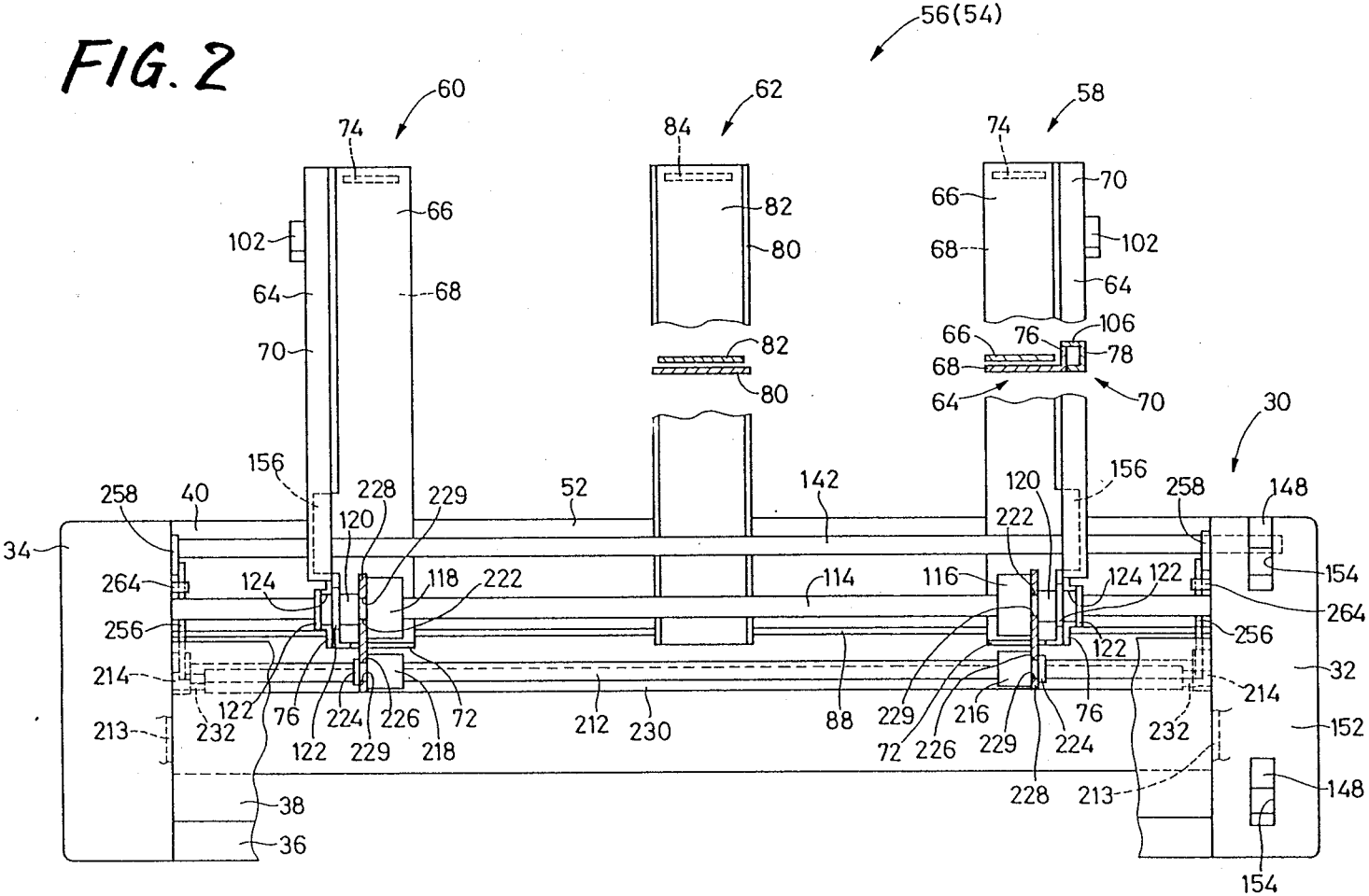
FIG. 2 is a plan view of a second sheet stacker and related components of the feeding apparatus of FIG. 1.

The center and rear frames 38, 40 have respective inclined surfaces 50, 52 which extend obliquely in rear upward directions. A first stacker 54 and a second stacker 56 are mounted on these inclined surfaces 50, 52. As indicated in FIG. 2 which illustrates the second stacker 56 by way of example, each of the first and second stackers 54, 56 has a left support 58 and a right support 60 which support left and right ends of a stack of recording media in the form of cut sheets, and a center support 62 which supports a central portion of the sheet stack. Since the first and second stackers 54, 56 are basically similar to each other in construction, only the second stacker 56 will be described by reference to FIG. 2. It will be understood that the description of the second stacker 56 substantially applies to the first stacker 54.

Each of the three supports 58, 60, 62 is supported on the inclined surface 52 slidably in the lateral direction of the printer, so that the lateral positions of these supports 58, 60, 62 may be adjusted to a desired lateral position of the sheet stack and to a desired width of the cut sheets. The center support 62 is removable when it is not needed. Namely, this center support 62 is used to aid the left and right supports 58, 60 in supporting the sheet stack in a straight flat posture, particularly when the width of the cut sheets is relatively large.

As shown in FIG. 2, each of the left and right supports 58, 60 includes a main frame 64, and a sheet support plate 66 which extends in the sheet feeding direction for supporting the sheet stack at its bottom. The main frame 64 includes a generally planar base 68 which extends obliquely parallel to the inclined surface 52, a channel frame 70 which extends from the outer side end (left end for the left support 58, or right end for the right support 60) of the planar base 68, and a front plate 72 which extends from the front end of the planar base 68.

As shown in FIG. 1, the sheet support plate 66 of each of the left and right supports 58, 60 is connected at its rear end to the corresponding rear end of the main frame 64, by a shaft 74 which extends in the lateral direction of the printer, such that the sheet support plate 66 is pivotable at its rear end about the shaft 74. The stack of multiple cut sheets superposed on each other on the left and right sheet support plates 66, 66 is positioned at its front end by the front plates 72. Further, the sheet stack is positioned at its left and right ends by respective inner side plates 76 of the channel frames 70, 70 which face outer side plates 78. More specifically, the left and right ends of the sheet stack are determined by their abutting contact with the outer surfaces of the inner side plates 76 which are remote from the outer side plates 78.

On the other hand, the center support 62 includes a generally planar main frame 80 which extends obliquely parallel to the inclined surface 52, and a sheet support plate 82 which supports the sheet stack at its bottom, as indicated in FIG. 2. Like the sheet support plates 66, 66 of the left and right supports 58, 60, the sheet support plate 82 is connected at its rear end to the rear end of the main frame 80, pivotally about a shaft 84 which extends in the lateral direction of the printer.

Figure 3:
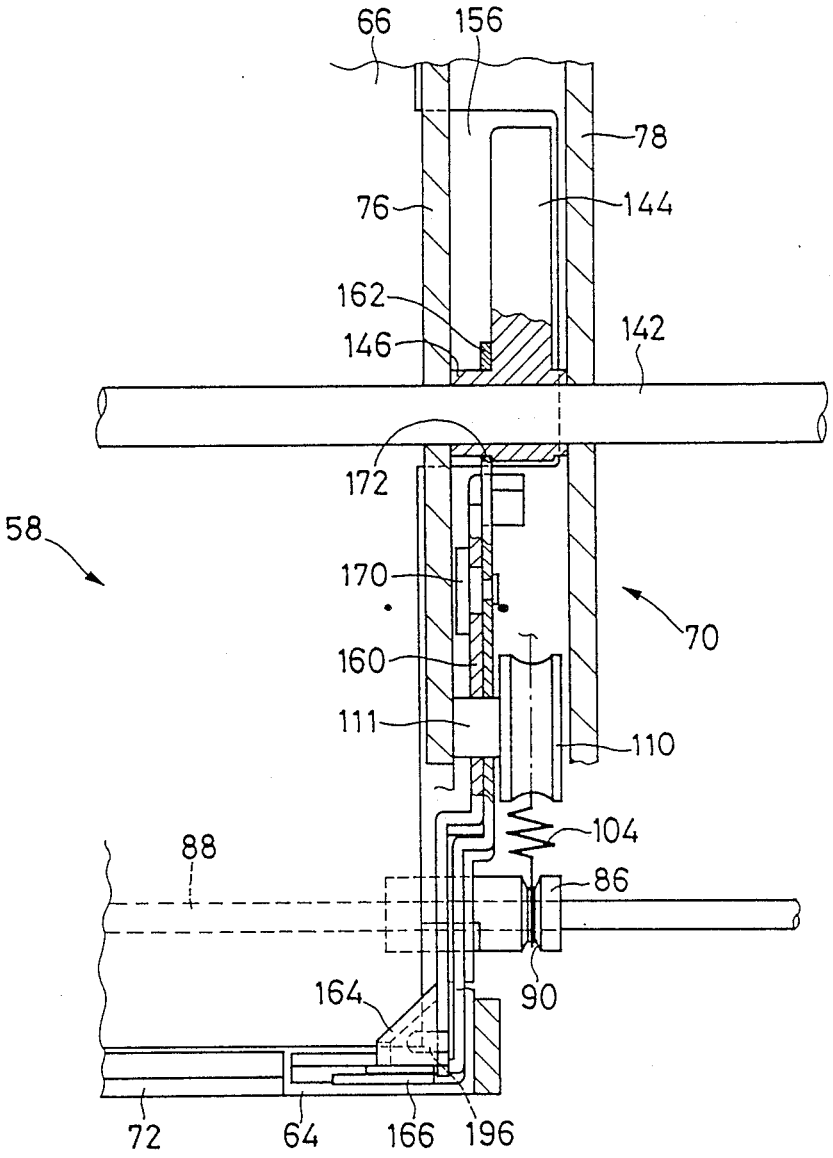
FIG. 3 is a fragmentary plan view in cross section of a left support of the first and second sheet stackers of the feeding apparatus.

As indicated in FIG. 1, the lower end portion of the main frame 64, 80 of each support 58, 60, 62 is rearwardly convexed so as to define an internally formed recess in which is accommodated a corresponding hollow cylindrical member 86. The cylindrical members 86 are secured to the rear surfaces of the respective sheet support plates 66, 82, so as to extend in the lateral direction of the printer. A common connecting rod 88 extends through these cylindrical members 86 so as to connect the sheet supports plates 66, 82. Each of the cylindrical members 86 of the left and right supports 58, 60 has an annular groove 90 which is aligned with the channel frame 70 of the support 58, 60, as shown in FIG. 3. The function of this annular groove 90 will be described.

Figure 4:
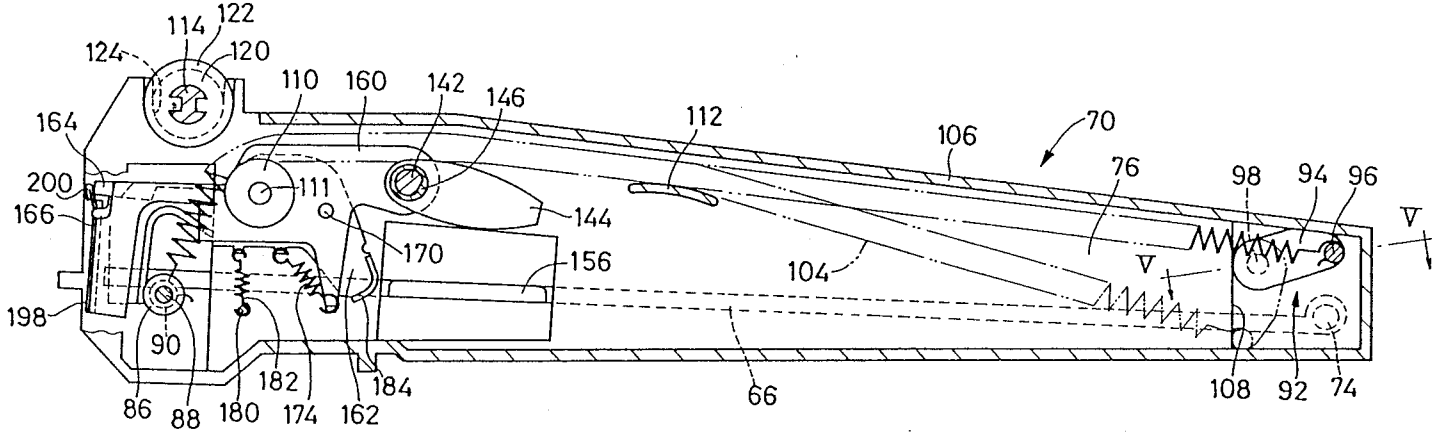
FIG. 4 is a side elevational view in cross section of a channel frame of the left support of FIG. 3, with an outer side plate of the frame removed to show the interior of the frame.

As shown in FIGS. 4 and 5, a pivotable frame 92 is disposed within the rear end portion of the channel frame 70 of each of the left and right supports 58, 60. The pivotable frame 92 is a generally C-shaped structure which includes a pair of side plates 94, 94 which are slidable on the opposed inner surfaces of the inner and outer side plates 76, 78 of the channel frame 70, and a connecting shaft 96 which connects the side plates 94 at their rear ends. Further, the pivotable frame 92 is formed with a pair of pivot shafts 98, 100 which extend through the respective side plates 76, 78 of the channel frame 70, such that the pivot shafts 98, 100 are slidably rotatable relative to the side plates 76, 78. The outer pivot shaft 100 protrudes from the outer surface of the outer side plate 78, and a push-up force selector lever 102 is secured to the protruding end portion of the outer pivot shaft 100.

As illustrated in FIG. 4, spring 104 is connected at its one end to the annular groove 90 of the hollow cylindrical member 86, and at the other end to the connecting shaft 96 of the pivotable frame 92, so that the sheet support plates 66, 82 are biased in a clockwise direction (as seen in FIG. 4) about the corresponding shafts 74, 84. The pivotable frame 92 has a first position indicated in solid line in FIG. 4, and a second position indicated in two-dot chain line in FIG. 4. In the first position, the upper surface at the free end of the side plate 94 of the pivotable frame 92 is in abutting contact with the inner surface of an upper plate 106 of the channel frame 70. In the second position, the lower surface at the free end of the side plate 94 is in abutting contact with a shoulder surface 108 formed in the inner surface of the inner side plate 76 of the channel frame 70. When the pivotable frame 92 is placed in the first position, the spring 104 biases the pivotable frame 92 in the counterclockwise direction as seen in FIG. 4. In the second position, the spring 104 biases the pivotable frame 92 in the clockwise direction. While the spring 104 produces a push-up force which acts on the sheet support plates 66, 82 in the upward direction, the push-up force produced by the spring 104 is larger when the pivotable frame 92 is placed in the first position, than in the second position. That is, the spring 104 is elongated by a suitable distance when the pivotable frame 92 is pivoted from the second position to the first position. The purpose of changing the push-up force will be described later in detail.

In FIG. 4, reference numeral 110 denotes a guide roll which is rotatably mounted on a shaft 111 secured to the inner surface of the inner side plate 76 of the channel frame 70. This guide roll 110 serves to guide the spring 104, while permitting uniform elongation and contraction of the same over its entire length. Further, reference numeral 112 in the same figure denotes a guide which is formed on the inner surface of the inner side plate 76 of the channel frame 70, for guiding the spring 104 so as to avoid its contact with other components within the channel frame 70.

Above the front end portion of the first and second stackers 54, 56, there are disposed respective drive shafts 114, 114, as shown in FIG. 2, such that the shafts 14 extend in the lateral direction of the printer. The opposite ends of each shaft 114 are positioned within the left and right frames 32, 34. Two feed rolls 116, 118 are mounted on the drive shaft 114, at positions corresponding to the left and right supports 58, 60. The feed rolls 116, 118 are rotated by the drive shaft 114, and are slidably movable on the drive shaft 114 in the axial direction. The feed rolls 116, 118 are provided with integrally formed coaxial extensions 120. Each of these extensions 120 has two axially spaced-apart annular protrusions 122, 122. On the other hand, the inner side plate 76 of the channel frame 70 of each support 58, 60 has a U-shaped groove 124 which is open upwardly. The U-shaped groove 124 is partly defined by a U-shaped flange which extends from the inner side plate 76. The extensions 120 of the two feed rolls 116, 118 engage the U-shaped grooves 124 of the left and right supports 58, 60 such that a portion between the two annular protrusions 122 of each extension 120 is slidably fitted in the corresponding U-shaped groove 124. In this arrangement, the feed rolls 116, 118 are axially movable together with the left and right supports 58, 60.

The drive shaft 114 of the first stacker 54 is connected at its one end within the right frame 34, to a gear 134 through a one-way clutch 136, which meshes with a pinion 140 within the right frame 34. The pinion 140 is connected to an electric motor 138, which is operated so as to rotate the feed rollers 116, 118 in the clockwise direction as seen in FIG. 1. The one-way clutch 136 functions to transmit a clockwise motion of the gear 134 to the drive shaft 114, and also functions to permit free clockwise rotation of the drive shaft 114 without the clockwise motion of the gear 134 by the motor 138. With the feed rolls 116, 118 rotated while in contact with the uppermost sheet of the sheet stack placed on the sheet support plates 66, 82, an advancing force to move the uppermost sheet in the feeding direction is produced by the feed rolls 116, 118. At the same time, advancing forces which are smaller than that applied to the uppermost sheet are applied to the other sheets of the stack, due to friction forces produced between the adjacent sheets. It will be understood that the feed rolls 116, 118 used in the present embodiment serve to deliver the cut sheets one after another from the first and second stackers 54, 56. The drive mechanism of the drive shaft 114 for the second stacker 56 is different from that of the drive shaft 114 of the first stacker 54, and will be described later.

Above the drive shaft 114 of each stacker 54, 56, there is disposed a rotating shaft 142 which extends in the lateral direction of the printer, with the opposite ends positioned within the left and right frames 32, 34, as indicated in FIG. 2. The rotating shaft 142 extends through the inner and outer side plates 76, 78 of the channel frames 70 of the left and right supports 58, 60. A push-down cam 144 is secured to a portion of the rotating shaft 142 which is located within the channel frame 70 of each support 58, 60, as shown in FIGS. 3 and 4. Each push-down cam 144 is provided with an integral sleeve 146 which is fitted on the rotating shaft 142 such that the sleeve 146 is rotated with the shaft 142 and is slidably movable in the axial direction of the shaft 142. The length of the sleeve 146 is slightly smaller than a distance between the inner and outer side plates 76, 78 of the channel frame 70, so that only a small gap is left between the end faces of the sleeve 146 and the side plates 76, 78. In the present arrangement, the push-down cams 144 are movable in the axial direction of the rotating shaft 142, together with the left and right supports 58, 60.

A sheet loading lever 148 is fixed to the end of the rotating shaft 142 which is located within the left frame 32, as shown in FIG. 8. The sheet loading lever 148 has an operating portion 150 which projects upwardly through an aperture 154 formed in an upper plate 152 of the left frame 32. The sheet loading lever 148 is normally placed in its original position in which the push-down cams 144 are placed in their original position shown in FIG. 9. When the sheet loading lever 148 is turned to a position indicated in two-dot chain line in FIG. 8, the push-down cams 144 are turned to a position indicated in two-dot chain line in FIG. 9. In this instance, the free end face of the push-down cams 144 is brought into contact with an upper surface of an ear 156 which extends from the outer side of the corresponding sheet support plate 66, in parallel with the plate 66, whereby the sheet support plates 66, 82 are pushed down by the push-down cams 144, against a biasing action of the spring 104. As a result, the uppermost sheet of the sheet stack is moved away from the feed rolls 116, 118. Namely, the pressed contact between the sheet stack and the feed rolls 116, 118 is released. In this condition, the cut sheets of the stack may be removed, or the stackers 54, 56 may be loaded with a stack of cut sheets. In FIG. 8, reference numeral 158 designates a spring for biasing the sheet loading lever 148 in the counterclockwise direction (as seen in the figure) with a small force, to thereby maintain the lever 148 in its original position (indicated in solid line in the figure).

Figure 9:
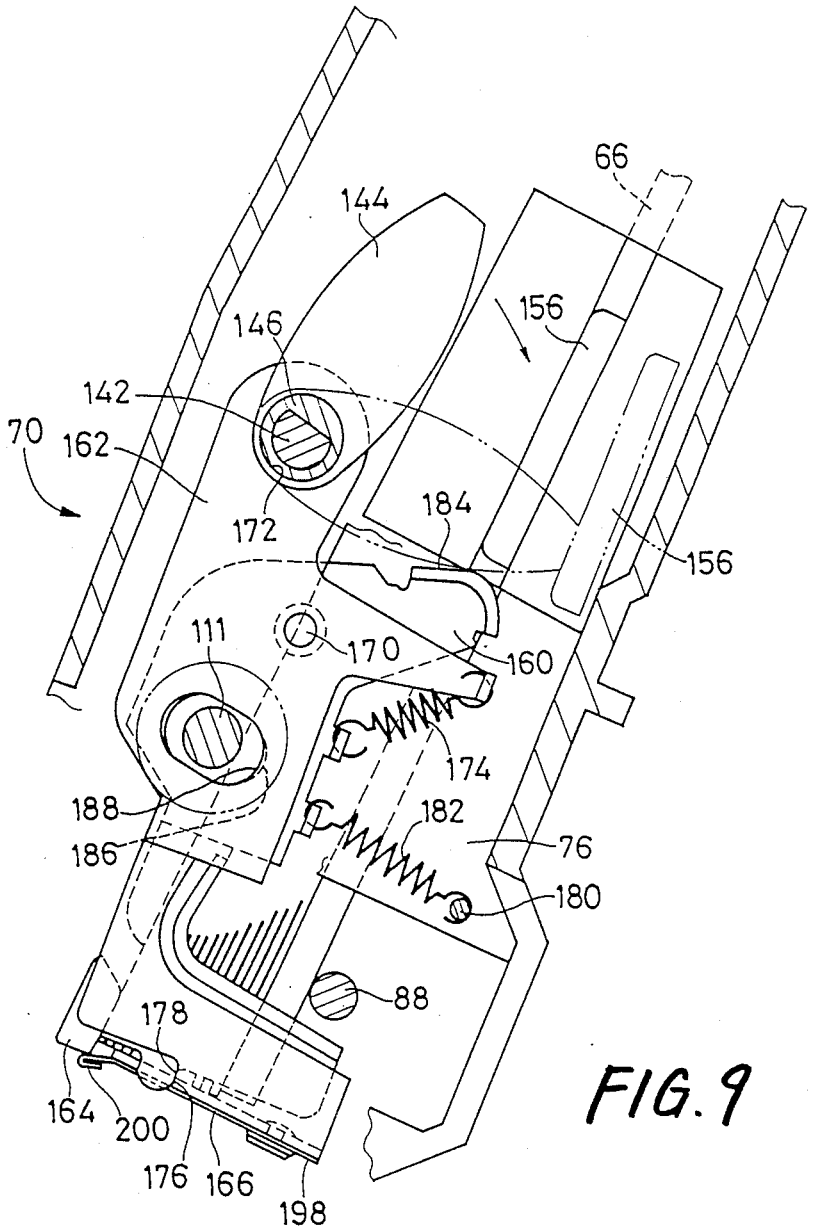
FIG. 9 is a fragmentary side elevational view in cross section, indicating a positional relation between a first and a second link plate of the apparatus, which permits a sheet to be delivered from the stacker.
Figure 10:
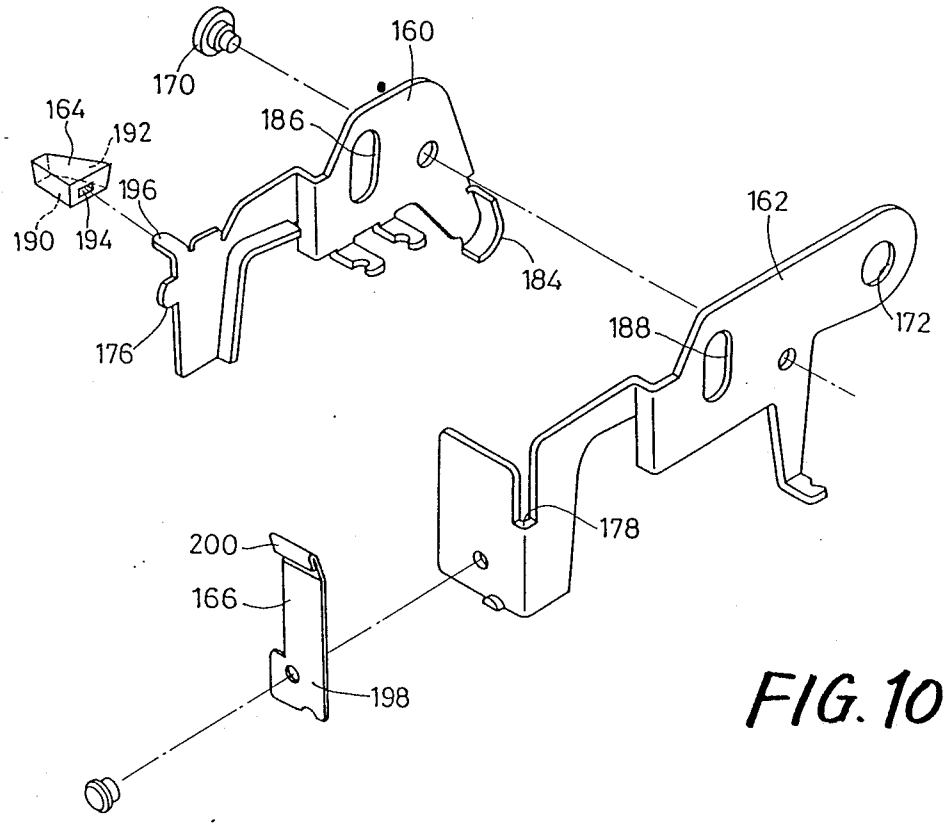
FIG. 10 is a perspective view of the first and second link plates of FIG. 9.

As illustrated in FIG. 9, a first link plate 160 and a second link plate 162 shown in the perspective view of FIG. 10 are disposed within the channel frame 70 of each support 58, 60. A presser member in the form of a presser plate 164 (which will be described) is fixed to one end of the first link plate 160, while an elastic member in the form of a sheet spring 166 (which will be described) is fixed to the corresponding end of the second link plate 162. The first and second link plates 160, 162 are connected to each other by a pin 170 such that the two link plates 160, 162 are pivotable relative to each other in a plane parallel to their planes. The second link plate 162 has a through hole 172 formed in an end portion thereof remote from the end to which the sheet spring 166 is fixed. The sleeve 146 of the push-down cam 144 extends through the through hole 172, such that the second link plate 162 is pivotable about the sleeve 146. Like the push-down cams 144, the two link plates 160, 162 are movable together with the left and right supports 58, 60.

As shown in FIG. 9, the first and second link plates 160, 162 are biased by a first coil spring 174 in a direction that causes the presser plate 164 and the elastic member 166 to move toward each other. A maximum relative pivotal movement of the two link plates 160, 162 is determined by abutting contact between a lower surface of a stop tab 176 formed integrally with the first link plate 160, and an upwardly facing stop surface 178 formed on the second link plate 162.

Figure 11:
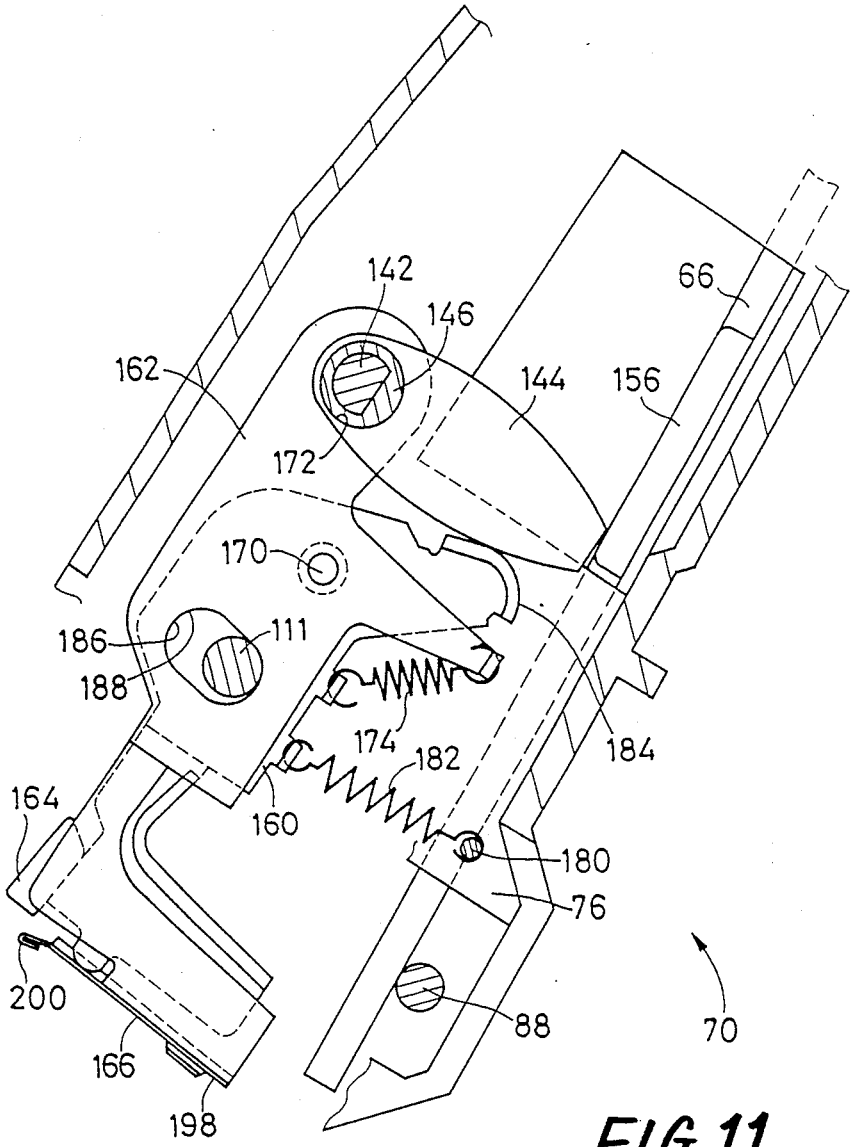
FIG. 11 is a fragmentary side elevational view in cross section, indicating another positional relation between the first and second link plates, which is established by turning the sheet loading lever from its sheet loading position.

A second coil spring 182 is connected to the first link plate 160 and a pin 180 formed on the inner surface of the inner side plate 76 of the channel frame 70, whereby the first link plate 160 is biased toward the sheet support plate 66. The first link plate 160 also has an abutting surface 184 formed as an integral part thereof at a position adjacent to the push-down cam 144, so that the push-down cam 144 may abut on the abutting surface 184. While the push-down cam 144 is moved to its sheet loading position (indicated in two-dot chain line in FIG. 9) to place the sheet support plates 66, 82 in the lowered position, the push-down cam 144 causes substantially no pivotal movement of the first link plate 160, with the lower or front surface of the push-down cam 144 only slightly contacting the abutting surface 184 of the first link plate 160. With a further pivotal movement of the push-down cam 144 in the clockwise direction as indicated in FIG. 11, the first and second link plates 160, 162 are pivoted as a unit about the rotating shaft 142, in a direction away from the sheet support plate 66, i.e., in the clockwise direction, against the biasing action of the spring 182.

The first and second link plates 160, 162 have respective elongate holes 186, 188 through which the shaft 111 described above extends, as depicted in FIG. 3. The elongate holes 186, 188 are positioned and dimensioned such that the inner surface of the elongate hole 188 of the second link plate 162 is brought into abutting contact with the circumferential surface of the shaft 111, at a slightly earlier point of time than the timing at which the inner surface of the elongate hole 186 of the first link plate 160 abuts on the shaft 111, during pivotal movements of the two link plates 160, 162 as a unit. Accordingly, after the pivotal movements of the two link plates 160, 162 as a unit are inhibited by the abutting contact between the shaft 111 and the elongate hole 188 of the second link plate 162, only the first link plate 160 is pivoted relative to the second link plate 162, against the biasing forces of the first and second coil springs 174, 182, whereby a clearance between the presser plate 164 and the sheet spring 166 in the pivoting direction of the plate 160 is increased. The pivotal movement of the first link plate 160 is limited by the abutting contact of the inner surface of the elongate hole 186 with the shaft 111, and the pivotal movement of the push-down cam 144 is consequently limited. In the present embodiment, the sheet loading lever 148, rotating shaft 142, push-down cams 144, first link plates 160, second link plates 162, pins 170, 180, first and second coil springs 174, 182, and shafts 111 cooperate with each other to constitute clearance enlarging means for enlarging the clearance between the lower surface of the presser plate 164 and the upper end of the sheet spring 166.

Figure 12:
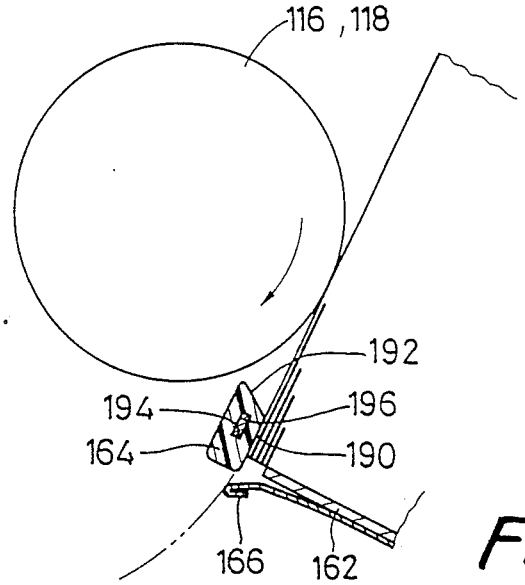
FIG. 12 is a side cross sectional view illustrating a manner in which an uppermost sheet of a stack of relatively hard sheets placed on sheet support plates of the stacker is delivered.

The presser plates 164 fixed to the left and right first link plates 160 are adapted to contact the left and right front corners of the upper surface of the uppermost sheet of the sheet stack placed on the sheet support plates 66, 82. The presser plates 164 are formed of a synthetic resin. The lower surface of each presser plate 164 which cooperates with the sheet spring 166 to define the clearance through which the uppermost sheet passes consists of a first flat area or contact area 190 parallel to the path of the uppermost sheet, and a second area or guide area 192 which extends from the rear end of the contact area 190, obliquely in a rear upward direction, such that the distance between the uppermost sheet of the sheet stack and the guide area 192 increases with a distance between the rear end of the contact area 190 and the guide area 192, as indicated in FIG. 12. The presser plate 164 has a central hole 194 formed in the lateral direction of the printer. As shown in FIG. 10, the first link plate 160 has an integrally formed planar tab 196 which engages the central hole 194. Thus, the presser plate 164 is secured to the first link plate 160.

The sheet springs 166 are fixed to the left and right second link plates 162, such that the sheet springs 166 are located adjacent to the presser plates 164. While the first and second link plates 160, 162 are placed in the sheet feeding position of FIG. 9 in which the presser plates 164 and the sheet springs 166 are closest to each other, each presser plate 164 contacts the corresponding sheet spring 166 in substantially perpendicular relation with each other, as indicated in FIG. 9. The sheet spring 166 is fixed by a rivet at a lower end portion 198 thereof to the second link plate 162. That is, the sheet spring 166 is supported at its fixed or lower end portion 198 in a cantilever fashion. Accordingly, when the left and right ends of the leading edge of the uppermost sheet advanced by the feed rolls 116, 118 contact the sheet spring 166, the spring 166 is elastically deformed according to a force of contact between the sheet and the spring 166. The free end portion of the sheet spring 166 remote from the fixed end portion 198 is folded frontwardly in the feeding direction of the sheet, as indicated at 200 in FIG. 10, in order to reduce its contact resistance to the uppermost sheet when the sheet is passed between the presser plate 164 and the sheet spring 166.

With the left and right presser plates 164 and the corresponding sheet springs 166 which have been described, only the uppermost one of the cut sheets of the stack on the sheet support plates 66, 82 is delivered from the sheet stacker 54, 56. Described in greater detail, a greater advancing force is applied to the uppermost sheet by the feed rolls 116, 118, than to the other sheets. Therefore, the uppermost sheet abuts on the sheet springs 166 with a greater abutting force. Where the uppermost sheet is comparatively hard or stiff, the advancing force causes the sheet to elastically deform or deflect the sheet springs 166, rather than causing the sheet to be curved or deflected, whereby the clearances between the presser plates 164 and the sheet springs 166 are enlarged to a value sufficient to permit the uppermost sheet to pass through the clearances. Thus, only the uppermost sheet is delivered through the clearances.

Figure 13:
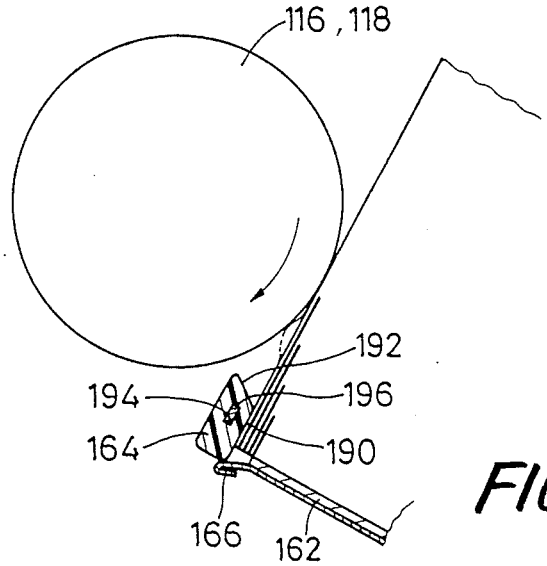
FIG. 13 is a side cross sectional view illustrating a manner in which an uppermost sheet of a stack of relatively soft sheets is delivered from the stacker.

In the case where the uppermost sheet is comparatively soft, the abutting contact of the uppermost sheet with the sheet springs 166 will not cause the clearances between the presser plates 164 and the sheet springs 166 to be enlarged to a sufficient value for permitting the sheet to be advanced through the clearances. Consequently, the uppermost sheet is upwardly curved at a portion between the presser plates 164 and the feed rolls 116, 118, as indicated in FIG. 13. As a result, only the uppermost sheet passes over the presser plates 164, and is delivered from the stacker.

It follows from the above description that the presser plates 164 serve as presser members engageable with the upper surface of the uppermost sheet of the sheet stack, while the sheet springs 166 serve as elastic members which are elastically deformed in the sheet feeding direction according to a force of contact between the elastic member and the leading edges of the sheet stack.

The second stacker 56 has some elements which are not provided in the first stacker 54. These additional elements of the second stacker 56 will be described.

The second stacker 56 is provided with a drive shaft 212 which is disposed below and adjacent to the drive shaft 114, so as to extend parallel to the drive shaft 114, as indicated in FIG. 2. This drive shaft 212 is rotatably supported at its opposite ends by a pair of bosses 214 which are formed on inner side plates 213 of the left and right frames 32, 34. Two advancing rolls 216, 218 are slidably mounted on respective portions of the drive shaft 212, which correspond to the feed rolls 116, 118 mounted on the drive shaft 114. The advancing rolls 216, 218 are rotated with the drive shaft 212 and are axially movable relative to the drive shaft 212.

The extensions 120 of the feed rolls 116, 118 have respective annular grooves 222, 222 formed in the circumferential surfaces. The advancing rolls 216, 218 also have extensions 224 which have respective annular grooves 226, 226 formed in the outer circumferential surfaces. The extensions 120 and 224 are connected to each other by connecting plates 228 such that U-shaped recesses 229 formed in the connecting plates 228 engage the annular grooves 222 and 226. Thus, the feed rolls 116, 118 and the advancing rolls 216, 218 are moved in the lateral direction of the printer, together with the left and right supports 58, 60.

Figure 7:
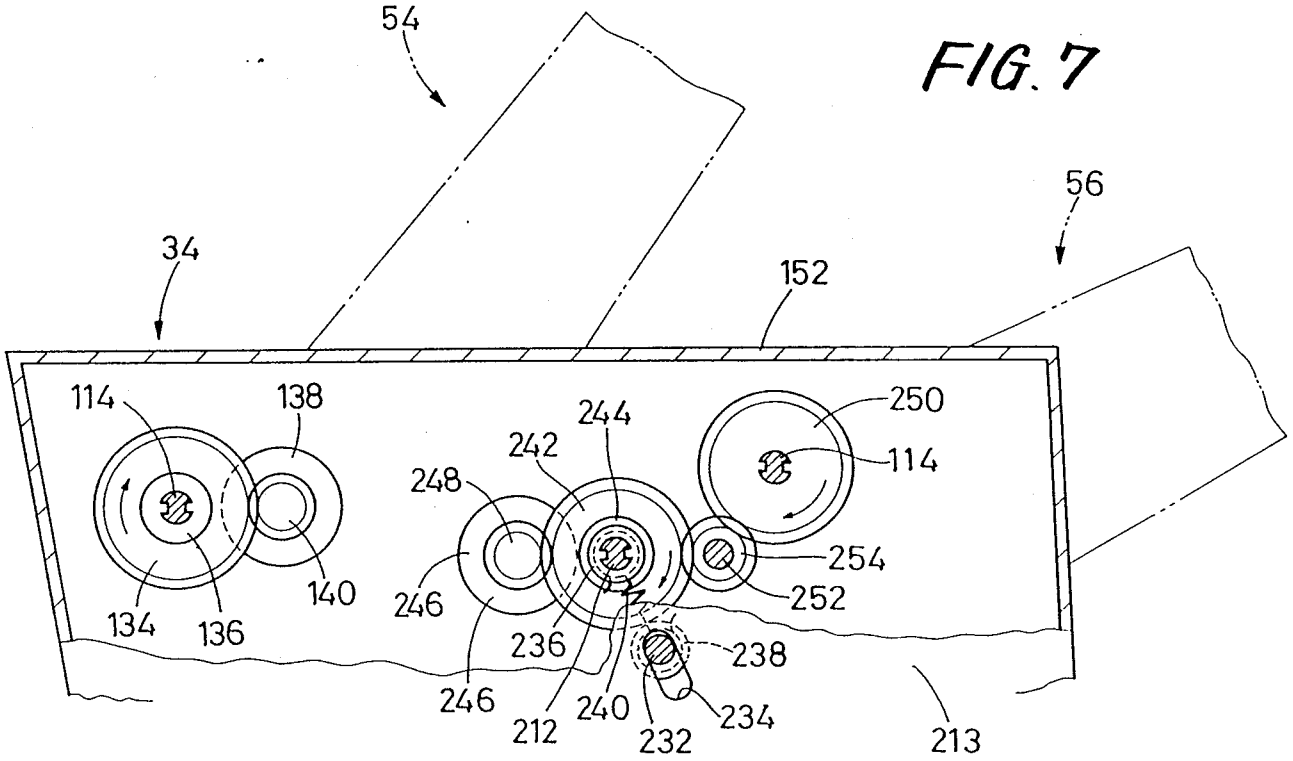
FIG. 7 is a fragmentary side elevational view in cross section of a gearing arrangement within a right frame of the feeding apparatus.

Below and adjacent to the drive shaft 212, there is disposed another advancing roll in the form of an idler presser roll 230, so as to extend parallel to the drive shaft 212. The presser roll 230 has small-diameter end portions 232 which extend through elongate holes 234 formed through the inner side plates 213 of the left and right frames 32, 34, as shown in FIG. 7. The elongate holes 234 are formed so as to extend in a direction in which the drive shaft 212 and the idler presser roll 230 are spaced apart from each other. Springs 240, 240 are connected to the drive shaft 212 and the small-diameter end portions 232, via guide rollers 236, 238, so that the drive shaft 212 and the idler presser roll 230 are biased toward each other, whereby the advancing rolls 216, 218 and the presser roll 230 are normally held in pressed contact with each other.

The opposite ends of the drive shaft 212 positioned within the left and right frames 32, 34 are connected to gears 242 via a one-way clutch 244. The gear 242 positioned within the right frame 34 meshes with a pinion 248 within the right frame 34. The pinion 248 is connected to an electric motor 246, which is operated to rotate the drive shaft 212 in the clockwise direction as seen in FIG. 7. With the clockwise rotation of the drive shaft 212 while the advancing rolls 216, 218 and the idler presser roll 230 are held in pressed contact with each other, the presser roll 230 is rotated in the counterclockwise direction. As a result, the cut sheet passing through the pressure nip between the rotating rolls 216,

218 and 230 is advanced in the sheet feeding direction. In the present embodiment, therefore, the advancing rolls 216, 218 cooperate with the idler presser roll 230 to constitute a pair of advancing rolls for advancing the uppermost sheet delivered from the second stacker 56, toward the printer, in contact with the upper and lower surfaces of the uppermost sheet.

As shown in FIG. 7, gears 250 are connected to the opposite ends of the drive shaft 114 of the second stacker 56, within the left and right frames 32, 34. The gears 250 mesh with the corresponding gears 242, through small-diameter intermediate gears 254 which are rotatably mounted on respective shafts 252 formed on the inner surfaces of the inner side plates 213 of the left and right frames 32, 34. In this arrangement, a rotary motion of the drive shaft 212 is imparted to the drive shaft 114 through the one-way clutch 244, intermediate gears 254 and gears 250, whereby the drive shaft 114 is rotated in the same direction as the drive shaft 212.

Figure 14:
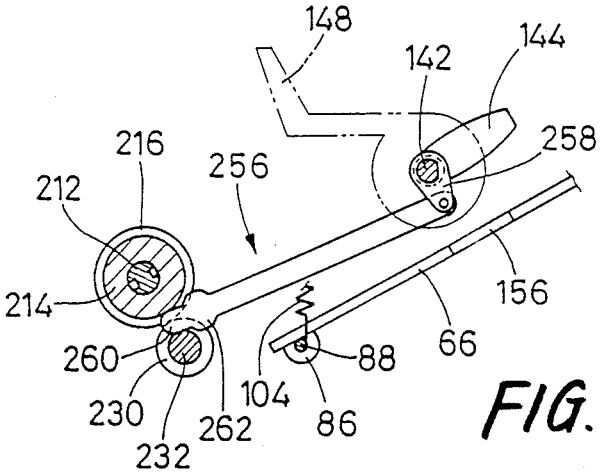
FIGS. 14 and 15 are fragmentary side elevational views in cross section, illustrating a pressure-nip release mechanism of the apparatus which includes a cam for moving a pair of advancing rolls away from each other.

The bosses 214 and the idler presser roll 230 are positioned such that there exists a spacing between the outer circumferential surface of each boss 214 and the outer circumferential surface of the corresponding small-diameter end portion 232 of the presser roll 230, while the advancing rolls 216, 218 are held in pressed contact with the presser roll 230, as illustrated in FIG. 14. An end portion of an elongate planar cam 256 is positioned in the above-indicated spacing such that the cam 256 is perpendicular to the axes of the rolls 216, 218, 230. As indicated in FIG. 2, the two elongate planar cams 256 are disposed adjacent and parallel to the outer surfaces of the inner side plates 213 of the left and right frames 32, 34, and are connected to the rotating shaft 142 through link plates 258 which are secured to the shaft 142, so that the cams 256 are moved relative to the bosses 230 and small-diameter end portions 232 of the presser roll 230.

Figure 15:
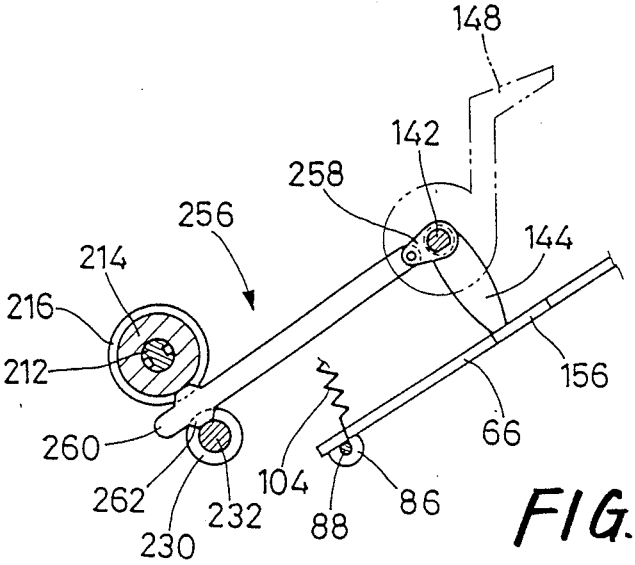

While the sheet loading lever 148 is in the original position, an end portion 260 of each elongate cam 256 is held in slightly pressed contact with the circumferential surfaces of the boss 214 and the small-diameter end portion 232. In this condition, the end portion 260 permits the advancing rolls 216, 218 and the presser roll 230 to be maintained in pressed contact with each other under the biasing force of the spring 240 as shown in FIG. 7. When the sheet loading lever 148 is turned to the sheet loading position (in which the push-down cams 144 maintain the sheet support plates 66 in the lowered position), the elongate cams 256 are advanced a suitable distance between the bosses 214 and the small-diameter portions 232, whereby a cam portion 262 formed rearwardly of the end portion 260 of each cam 256 is brought into contact with the outer circumferential surfaces of the corresponding boss 214 and small-diameter end portion 232, as indicated in FIG. 15. Since the cam portion 262 has a larger width than the end portion 260, the presser roll 230 is moved away from the advancing rolls 216, 218, along the elongate holes 234, against the biasing forces of the springs 240. As a result, the pressed contact between the advancing rolls 216, 218 and the presser roll 230 (another advancing roll) is released. It follows from the above explanation that the sheet loading lever 148, rotating shaft 142, link plates 258 and elongate cams 256 constitute pressure-nip release means for moving the rolls 216, 218 and the roll 230 away from each other and thereby releasing a condition in which the rolls 216, 218, 230 maintain a pressure nip therebetween. It is noted that reference numeral 264 in FIG. 2 designates guide members 264 attached to the outer surfaces of the inner side plates 213 of the left and right frames 32, 34, in order to prevent movements of the elongate cams 256 in their transverse direction.

An operation of the instant feeding apparatus 30 will be described.

There will be first described a manner in which a cut sheet is supplied from the first stacker 54 to the printer.

Initially, the sheet loading lever 148 is turned from the original position to the sheet loading position (in which the push-down cams 144 contact the ears 156 of the sheet support plates 66, in perpendicular relation with each other), to lower the sheet support plates 66, 82 away from the feed rolls 116, 118, for loading the first stacker 54 with a stack of cut sheets. Then, the stack (consisting of a suitable number of cut sheets) is placed on the sheet support plates 66, 82. If necessary, the lateral positions of the left and right supports 58, 60 and the center support 62 are adjusted to the cut sheets, before the first stacker 54 is loaded with the sheet stack. The feed rolls 16, 118 are moved in the lateral direction, together with the left and right supports 58, 60.

The push-up force selector lever 102 is normally placed in the second position indicated in two-dot chain line in FIG. 6, in which the sheet support plates 66, 82 are subject to a comparatively small push-up force. However, if the cut sheets are comparatively thick and hard or stiff, for example, it is necessary to turn the push-up force selecter lever 102 to the first position (indicated in solid line in FIG. 6), for increasing the push-up force which acts on the sheet support plates 66, 82 and thereby increasing the contact force between the uppermost cut sheet and the feed rolls 116, 118, so that the rotary motions of the feed rolls 116, 118 are effectively imparted to the uppermost sheet, for the uppermost sheet to be able to elastically deform the sheet springs 166.

Upon starting of a printing operation, the electric motor 138 shown in FIG. 7 is activated to rotate the feed rolls 116, 118 in the clockwise direction as seen in the figure, and an advancing force is applied to the cut sheets on the sheet support plates 66, 82. However, only the uppermost sheet of the sheet stack is delivered from the first stacker 54, through the clearances between the presser plates 164 and the corresponding sheet springs 166. The delivered uppermost sheet is directed toward the pair of feed rollers 24 of the printer.

When the leading edge of the cut sheet delivered from the first stacker 54 reaches the pressure nip between the feed rollers 24, the electric motor 138 is turned off and the rotation of the drive shaft 114 is stopped, to prevent the next cut sheet from being delivered from the first stacker 54 during a printing operation on the cut sheet which has been fed to the print head 17. After the completion of the printing operation on this cut sheet, the motor 138 is again activated to deliver the next cut sheet toward the print head 17.

If the trailing end portion of the delivered cut sheet remains in contact with the feed rolls 116, 118 after the electric motor 138 is turned off, the sheet must be advanced by the pair of feed rollers 24 to permit a printing operation on the delivered sheet. To meet this requirement, the feed rolls 116, 118 are connected to the pinion 140 of the motor 138 through the one-way clutch 136. This one-way clutch 136 permits the feed rolls 116, 118 to be rotated in the selected direction, i.e., in the sheet feeding direction, even while the motor 138 is off.

In the event that the first stacker 54 is not normally functioning due to jamming of a cut sheet between the presser plates 164 and the sheet springs 166 for some reason or other, the printer is turned off, and the sheet loading lever 148 is turned to its sheet loading position to lower the sheet support plates 66, 82 away from the feed rolls 116, 118. Then, the lever 148 is turned a further angle in the same direction, the presser plates 164 and the sheet springs 166 are moved as a unit in an upward direction away from the sheet support plates 66. With a further pivotal movement of the lever 148, only the presser plates 164 are moved upward away from the sheet support plates 66, whereby the clearances between the presser plates 164 and the sheet springs 166 are enlarged. In this condition, the cut sheet jammed between the presser plates 164 and the sheet springs 166 can be readily removed in the direction opposite to the sheet feeding direction, without damaging the sheet. Since the jammed uppermost sheet is not pressed by the feed rolls 116, 118 with a large contact force, the sheet can be pulled in the rearward direction even though the feed rolls 116, 118 are rotatable only in the sheet feeding direction.

There will next be described a manner in which cut sheets are delivered from the second stacker 56 to the printer.

The second stacker 56 is loaded with a stack of cut sheets, in the same manner as described with respect to the first stacker 54, except that the operation of the sheet loading lever 148 to the sheet loading position will cause the idler presser roll 230 to be moved away from the advancing rolls 216, 218, in addition to the movement of the sheet support plates 66, 82 away from the feed rolls 116, 118. Further, a movement of the left, right and center supports 58, 60, 62 in the lateral direction of the printer will cause the feed rolls 116, 118 and the advancing rolls 216, 218 to be moved together with the supports 58, 60, 62.

Upon starting of the printer with the second stacker 56 loaded with a sheet stack, the electric motor 246 shown in FIG. 7 is turned on to rotate the feed rolls 116, 118. As a result, the uppermost sheet of the stack on the sheet support plates 66, 82 is delivered through the clearances between the presser plates 164 and the sheet springs 166, in the same manner as described above with respect to the first stacker 54. Subsequently, the delivered sheet is advanced toward the pair of feed rollers 24, by the advancing rolls 216, 218 and the idler presser roll 230.

The electric motor 246 is then turned off and the rotation of the drive shaft 212 is stopped. As in the arrangement of the first stacker 54, the rolls 116, 118, 216, 218 are connected to the pinion 248 of the motor 246 through the one-way clutch 244. Accordingly, these rolls will not prevent the delivered sheet from being properly fed to the print head 17, even if the trailing end portion of the sheet remains pinched between the advancing rolls 216, 218 and the presser roll 230, or remains in contact with the feed rolls 116, 118 when the leading edge of the sheet reaches the feed rollers 24.

In the event that the second stacker 56 is not normally functioning due to jamming of a sheet between the presser plates 164 and the sheet springs 166, the sheet loading lever 148 is operated to its sheet loading position, as in the operation of the first stacker 54. Consequently, the sheet support plates 66, 82 are pushed down, and the presser roll 230 is moved away from the advancing rolls 216, 218, by advancing movements of the elongate cams 256. The sheet loading lever 148 is further turned in the same direction to enlarge the clearances between the presser plates 164 and the sheet springs 166. In this condition, the jammed sheet can be easily pulled out from the second stacker 56, in the rearward direction opposite to the sheet feeding direction, without the sheet damaged by the presser plates 164 and the sheet springs 66. Although the rolls 216, 218, 230 are not rotatable in the direction corresponding to the above-indicated rearward direction, the sheet loading lever 148 allows the jammed sheet pinched between the advancing rolls 216, 218 and the presser roll 230 to be easily pulled in the rearward direction, without a large force of contact of the sheet with the rolls 216, 218, 230. As in the first stacker 54, the sheet may be readily removed without a large force of contact of the sheet with the feed rolls 116, 118.

It follows from the foregoing description that the sheet loading lever 148 provided in the present embodiment permits an automatic enlargement of the clearances between the presser plates 164 and the sheet springs 166, and an automatic release of a pressure nip between the advancing rolls 216, 218 and the presser roll 230, i.e., automatic separation of the presser roll 230 from the advancing rolls 216, 218. The above enlargement of the clearances and the separation of the rolls 216, 218 from the roll 230 facilitate removal of the sheet which is jammed between the presser plates 164 and the sheet springs 166, without damaging the sheet, even when the jammed sheet is pinched between the rolls 216, 218 and the roll 230. Further, the removal of the sheet by using the lever 148 does not cause the presser plates 164 to be subjected to such a large stress that may deteriorate their function. In short, a simple operation of the single sheet loading lever 148 results in enlarging the above-indicated clearances while at the same time moving the presser roll 230 away from the advancing rolls 216, 218, thereby simplifying the procedure for removing the jammed sheet.

In the present embodiment of the feeding apparatus 30, the enlargement of the clearances and the release of the pressure nip between the advancing and presser rolls 216, 218, 230 are effected by utilizing a pivotal motion of the rotating shaft 142 which is provided to move the sheet support plates 66, 82 to the lowered or sheet loading position. Accordingly, the above-indicated enlargement and pressure nip release following the lowering of the sheet support plates 66, 82 can be attained by a simple linkage between the rotating shaft 142 and the mechanisms for the clearance enlargement of the presser plates 164 and the sheet springs 166, and the pressure nip release of the rolls 216, 218, 230. Therefore, the number of parts and the cost of manufacture of the apparatus 30 can be appreciably reduced.

The first and second stacker 54, 56 may accommodate envelopes or similar recording media which have folded portions such as gummed edges. Such recording media having folded portions are usually hard or stiff. In this case, the clearances beween the presser plates 164 and the sheet springs 166 must be enlarged by elastically deforming or deflecting the sheet springs 166, so that the hard medium can be delivered from the sheet support plates 66, 82, through the enlarged clearances. If the presser plates 164 were relatively thin plates having a sharp edge on the side of the leading edge of the recording medium, a folded portion of the medium may be caught by the edge of the presser plates and may be separated from the body of the medium, i.e., the folded portion may be damaged by the relatively thin presser plates. Further, there may arise a difference in the force of contact of the folded portion of the medium and the edge of the presser plates, between the left and right sides of the medium. In this instance, the recording medium which has passed the clearances between the presser plates 164 and the sheet springs 166 may be skewed and is likely to be jammed part way through the feeding path leading to the printer. In the present feeding apparatus 30, however, the leading edge of the folded portion of the medium is first brought into contact with the inclined second flat areas (guide area) 192 of the presser plates 164, which areas extend in a rear upward direction. The folded portion of the medium is guided along the inclined guide areas 192, into contact with the first flat areas (contact areas) 190. Thus, the recording medium having the folded portion may be smoothly delivered from the stacker, without damaging the folded portion. It will be understood that the height of the inclined guide area of the presser plates as measured in the direction of thickness of the recording medium must be larger than the thickness of the folded portion of the medium.

If the inclination of the sheet springs 166 with respect to the main frames 64, 80 of the first and second stackers 54, 56 was fixed, the inclination of the sheet support plates 66, 82 to the main frames 64, 80 differs depending upon the number of sheets of a sheet stack placed on the support plates 66, 82, that is, depending upon the thickness of the sheet stack. Accordingly, the angle of contact between the uppermost sheet of the stack and the sheet springs 166 accordingly differs. Therefore, even if the stiffness of the sheet is constant, the amount of elastic deformation of the sheet springs 166, and the clearances between the presser plates 164 and the sheet springs 166 vary with the thickness of the sheet stack, leading to feeding troubles of the sheets. In the illustrated embodiment, however, the sheet springs 166 are adapted to be pivoted about the rotating shaft 142. Further, the presser plates 164 and the sheet springs 166 are normally pivoted as a unit (while being biased toward each other by the spring 174 shown in FIG. 9) in substantially perpendicular relation with each other. Hence, provided that the lower surfaces of the presser plates 164 and the uppermost sheet of the stack are held parallel to each other, the the sheet springs 166 and the uppermost sheet abutting on the springs are maintained substantially at right angles to each other, assuring a substantially constant relationship between the stiffness of the sheet and the amount of deformation of the sheet springs 166, irrespective of the number of sheets of the stack.

Also, the present embodiment is adapted such that the clearances between the presser plates 164 and the sheet springs 166 are not enlarged when the sheet loading lever 148 is placed in the sheet loading position. The clearances are enlarged only when a further pivotal movement of the lever 148 from the sheet loading position reaches a perdetermined amount. If the clearances were enlarged in the sheet loading position of the lever 148, the uppermost sheet of the stack may possibly escape through the enlarged clearances. In this event, the operation of the lever 148 to its original position will cause the uppermost sheet to be subjected to an advancing force produced by the feed rolls 116, 118, while the sheet is pinched between the presser plates 164 and the sheet springs 166. If the sheet is relatively thin, the sheet is upwardly curved at a portion thereof between the feed rolls 116, 118 and the presser plates 164. Since the sheet is pinched between the presser plates 164 and the sheet springs 166, the sheet cannot be easily removed, and may be jammed between the feed rolls 116, 118 and the presser plates 164. In view of the above, the clearances between the presser plates 164 and the sheet springs 166 are not enlarged in the sheet loading position of the sheet loading lever 148, in order to prevent the uppermost sheet from escaping through the clearances, and thereby avoid a jamming trouble of the sheet.

Furthermore, the jammed sheet pinched between the presser plates 164 and the sheet springs 166 may be removed in the rearward direction opposite to the sheet feeding direction, even while the sheet loading lever 148 is in the sheet loading position, that is, even before the clearances between the plates 164 and the springs 166 are enlarged. Described more specifically, a rearward pull applied to the jammed sheet in the above condition will cause a force to move the presser plates 164 and the sheet springs 166 away from each other. When this force exceeds a biasing force of the spring 174 (shown in FIG. 9) which biases the presser plates 164 and the sheet springs 166 toward each other, the clearances are enlarged by the sheet which is being pulled rearwardly. Thus, the damage of the sheet which may occur during removal of the jammed sheet between the presser plates 164 and the sheet springs 166 can be minimized. Moreover, the instant arrangement assures a comparatively small amount of deformation of the sheet springs 166 during removal of the sheet, which deformation takes place in the direction opposite to that during a normal advancing movement of the sheet. Thus, the damage of the sheet springs 166 due to the forced elastic deformation during the sheet removal may be effectively reduced.

In connection with the elastic deformation of the sheet springs 166, it is noted that the free end portion 200 of the sheet springs 166 is folded frontwardly at an acute angle, so as to reduce a moment for rearwardly deflecting the sheet springs 166 when the jammed sheet is pulled in the rearward direction while kept in contact with the free end portion 200. Thus, the folded free end portion 200 permits a further reduction of the damage of the sheet springs 166 during removal of the jammed sheet.

The second stacker 56 of the present feeding apparatus 30 can be used with a stack of composite recording media each consisting of a plurality of sheets which are bound or stitched along one side thereof. In this case, the composite recording media are positioned on the sheet support plates 66, 82 such that the bound or stitched side of the media serves as the leading edge as viewed in the sheet feeding direction. Namely, when the uppermost composite medium is delivered from the second stacker 56, the bound side edge is brought into abutting contact with the sheet springs 166, and the sheet springs 166 are consequently elastically deformed with a result of enlarging the clearances between the presser plates 164 and the sheet springs 166, whereby the medium is delivered through the enlarged clearances. Since the advancing forces applied by the feed rolls 116, 118 to the individual sheets of the uppermost bound medium decrease in steps in the downward direction of the stack, whereby the lengths of the leading portions of the individual sheets which have passed the clearances between the presser plates 164 and the sheet springs 166 at a given point of time decrease in the downward direction. Namely, the uppermost sheet is advanced by the largest distance ahead of the clearances, and the lowermost sheet is advanced by the smallest distance. As a result, the leading portions of the individual sheet of the bound medium ahead of the clearances take the form of a crescent in longitudinal cross section, as a whole with the uppermost and lowermost sheets defining the profile of the crescent. If the bound medium is advanced toward the printer in the above state, the medium is jammed. In the second stacker 56 of the instant embodiment, however, the partly delivered medium is pinched by the advancing rolls 216, 218 and the presser roll 230, at a portion thereof behind the bound or stitched leading end, whereby the leading portion of the medium which has passed the pressure nip between the rolls 216, 218 and 230 is maintained substantially flat. Therefore, the second stacker 56 is capable of delivering a bound composite medium, without a jamming trouble.

While the present invention has been described in its presently preferred embodiment, the invention may be otherwise embodied.

Figure 16:
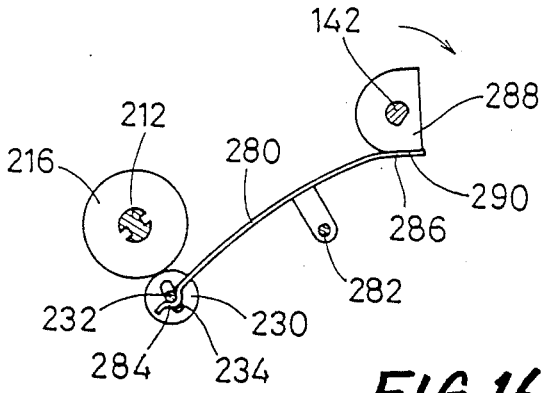
FIGS. 16 and 17 are fragmentary side elevational views in cross section, illustrating a modified pressure-nip release mechanism provided in another embodiment of the present invention.
Figure 17:
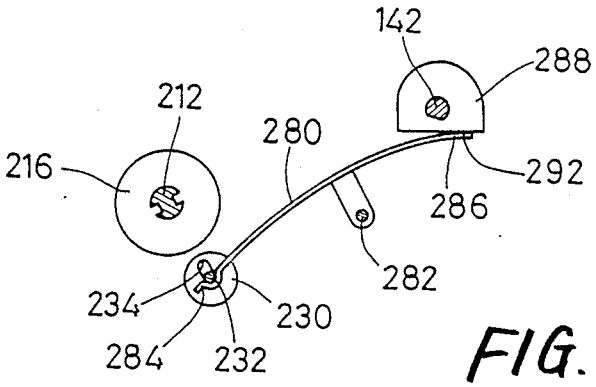

For example, the elongate cams 256 used in the preceding embodiment to separate the presser roll 230 from the advancing rolls 216, 218 may be replaced by two sheet springs 280 as shown in FIG. 16 (only one of the springs 280 being shown in the figure). The sheet springs 280 are disposed at positions corresponding to the cams 256, extending in the sheet feeding direction. The springs 280 are supported pivotally at their middle portions, by pins 282 which are formed on the outer surfaces of the inner side plates 213 of the left and right frames 32, 34, respectively. One end portion 284 of each sheet spring 280 is held in engagement with the corresponding small-diameter end portion 232 of the presser roll 230, so as to bias the presser roll 230 toward the advancing rolls 216, 218. The other end portion 286 is held in engagement with a cam 288 which is fixed to the rotating shaft 142. While the sheet loading lever 148 is placed in the original position, the cam 288 is placed in its operative position in which an operating surface 290 of the cam 288 contacts the sheet spring 280 as shown in FIG. 16. In this position, the presser roll 230 is elastically forced against the advancing rolls 216, 218 by a biasing force of the sheet spring 280. While the lever 148 is in the sheet loading position or in the further clockwise turned position, the cam 288 is placed in its inoperative position in which a non-operative surface 292 of the cam 288 contacts the sheet spring 280, as indicated in FIG. 17. In this position, the sheet spring 280 undergoes substantially no deflection or flexure, and the presser roll 230 is moved downward by its own weight, with the small-diameter end portions 232 being guided within the elongate holes 234. As a result, the pressure nip between the advancing rolls 216, 218 and the presser roll 230 is released. In the present modified embodiment, the sheet loading lever 148, rotating shaft 142, cam 288, sheet springs 280 and pins 282 constitute a pressure-nip release mechanism for moving the advancing rolls 216, 218 and the presser roll 230 (another advancing roll) away from each other. The present embodiment does not require the spring 140 (shown in FIG. 7) used in the preceding embodiment to bias the advancing rolls 216, 218 and the presser roll 230 toward each other.

It will be understood that the present invention is not limited to the preceise details of the illustrated embodiments, but may be embodied with various changes and improvements which may occur to those skilled in the art.

What is claimed is:

1. A feeding apparatus for feeding cut sheets one after another to a printer in a feeding direction, comprising:

a presser member engageable with an upper surface of an uppermost sheet of a stack of said cut sheets placed on a sheet support member, to thereby press said uppermost sheet toward said support member;

an elastic member disposed adjacent to said presser member and engageable with leading edges of said cut sheets, said elastic member being elastically deformed in said feeding direction according to a force of contact between said elastic member and said leading edges;

a feed roll engageable with said upper surface of said uppermost sheet, at a position rearwardly of said presser member, for exerting an advancing force on said uppermost sheet and thereby delivering said uppermost sheet toward said printer, through a clearance formed between said elastic member and said presser member due to elastic deformation of said elastic member; and a clearance enlarging mechanism for enlarging said clearance by moving said presser and elastic members away from each other.

2. A feeding apparatus for feeding cut sheets one after another to a printer in a feeding direction, comprising:

a presser member engageable with an upper surface of an uppermost sheet of a stack of said cut sheets placed on a sheet support member, to thereby press said uppermost sheet toward said support member;

an elastic member disposed adjacent to said presser member and engageable with leading edges of said cut sheets, said elastic member being elastically deformed in said feeding direction according to a force of contact between said elastic member and said leading edges;

a feed roll engageable with said upper surface of said uppermost sheet, at a position rearwardly of said presser member, for exerting an advancing force on said uppermost sheet and thereby delivering said uppermost sheet toward said printer, through a clearance formed between said elastic member and said presser member due to elastic deformation of said elastic member;

a support mechanism for supporting said presser member and said elastic member such that said presser and elastic members are movable toward and away from each other;

biasing means for biasing said presser and elastic members toward each other;

stop means for defining a maximum relative movement of said presser and elastic members toward each other; and a clearance enlarging mechanism for enlarging said clearance by moving said presser and elastic members away from each other against a biasing force of said biasing means.

3. A feeding apparatus according to claim 2, further comprising:

a contact release mechanism for moving said feed roll and said sheet support member away from each other and thereby releasing an operating condition in which said feed roll and said upper surface of said uppermost sheet are engageable with each other; and an operator's controlled operating device for operating both of said clearance enlarging mechanism and said contact release mechanism.

4. A feeding apparatus according to claim 3, wherein said operator's controlled operating device includes an operating member which is movable from an original position thereof to a first and a second position thereof, a movement of said operating member from said original position to said first position causing said contact release mechanism to operate while maintaining said clearance enlarging mechanism inoperative, and a movement of said operating member to said second position causing both of said clearance enlarging and contact release mechanisms to operate.

5. A feeding apparatus according to claim 2, wherein said support mechanism for supporting said presser member and said elastic member includes a link mechanism comprising a first link plate movable together with said presser member, a second link plate movable together with said elastic member, and a floating shaft which extends through said first and second link plates and thereby connects said first and second link plates pivotally thereabout in a plane parallel to planes of said link plates, said floating shaft being movable together with said link plates in said plane, said link mechanism further comprising a stationary shaft which is supported by a stationary member such that said stationary shaft is immovable in a direction intersecting an axis thereof and such that said first and second link plates are pivotable about the axis of said stationary shaft, said biasing means includes first biasing means connected to said first and second link plates for biasing said first and second link plates in a direction that causes said presser and elastic members to move toward each other, and second biasing means connected to said stationary member and one of said first and second link plates for biasing said first and second link plates in a direction that causes said presser member to move toward said upper surface of said uppermost sheet, said stop means includes first and second stoppers provided on said first and second link plates, respectively, such that said first and second stoppers are movable together with said first and second link plates, for defining said maximum relative movement of said presser and elastic members toward each other, said feeding apparatus further comprising third and fourth stoppers which are supported by said stationary member, said third stopper being abuttable on a fifth stopper provided on said first link plate, to thereby define a maximum movement of said second link plate about said stationary shaft against the biasing force of said second biasing means, and said fourth stopper being abuttable on a sixth stopper provided on said second link plate, to thereby define a maximum movement of said first link plate about said floating shaft against the biasing force of said first biasing means, after said maximum movement of said second link plate is established by abutting contact of said third and fifth stoppers.

6. A feeding apparatus according to claim 3, wherein said contact release mechanism includes a cam-type contact release mechanism which includes a cam for moving said feed roll and said sheet support member away from each other, said operator's controlled operating device includes a cam-type operating device which operates said clearance enlarging mechanism by utilizing a movement of said cam of said cam-type contact release mechanism.

7. A feeding apparatus according to claim 2, wherein said presser member has a lower surface which includes a contact surface which is engageable with said upper surface of said uppermost sheet, and a guide surface which extends from said contact surface rearwardly in a direction opposite to said feeding direction, said guide surface being inclined such that a distance between said upper surface of said uppermost sheet and said guide surface increases with a distance between said guide surface and said contact surface in said direction opposite to said feeding direction.

8. A feeding apparatus for feeding cut sheets one after another to a printer in a feeding direction, comprising:

a presser member engageable with an upper surface of an uppermost sheet of a stack of said cut sheets placed on a sheet support member, to thereby press said uppermost sheet toward said support member;

an elastic member disposed adjacent to said presser member and engageable with leading edges of said cut sheets, said elastic member being elastically deformed in said feeding direction according to a force of contact between said elastic member and said leading edges;

a feed roll engageable with said upper surface of said uppermost sheet, at a position rearwardly of said presser member, for exerting an advancing force on said uppermost sheet and thereby delivering said uppermost sheet toward said printer, through a clearance formed between said elastic member and said presser member due to elastic deformation o said elastic member;

a clearance enlarging mechanism for enlarging said clearance by moving said presser and elastic members away from each other;

a pair of advancing rolls for advancing said uppermost sheet delivered through said clearance, toward said printer, in contact with said upper surface and a lower surface of said uppermost sheet; and a pressure-nip release mechanism for moving said pair of advancing rolls away from each other and thereby releasing a condition in which said pair of advancing rolls maintain a pressure nip therebetween through which said uppermost sheet passes with said upper and lower surfaces thereof in contact with said pair of advancing rolls.

9. A feeding apparatus according to claim 8, wherein said clearance enlarging mechanism includes:

(a) a link mechanism comprising a first link plate movable together with said presser member, a second link plate movable together with said elastic member, and a floating shaft which extends through said first and second link plates and thereby connects said first and second link plates pivotally thereabout in a plane parallel to planes of said link plates, said floating shaft being movable together with said link plates in said plane, said link mechanism further comprising a stationary shaft which is supported by a stationary member such that said stationary shaft is immovable in a direction intersecting an axis thereof and such that said first and second link plates are pivotable about the axis of said stationary shaft;

(b) first biasing means connected to said first and second link plates for biasing said first and second link plates in a direction that causes said presser and elastic members to move toward each other;

(c) second biasing means connected to said stationary member and one of said first and second link plates for biasing said first and second link plates in a direction that causes said presser member to move toward said upper surface of said uppermost sheet;

(d) first and second stoppers provided on said first and second link plates, respectively, which are movable together with said first and second link plates for defining a maximum relative movement of said presser and elastic members toward each other;

(e) third and fourth stoppers which are supported by said stationary member;

(f) a fifth stopper provided on said first link plate, said third stopper being abuttable on said fifth stopper to thereby define a maximum movement of said second link plate about said stationary shaft against the biasing force of said second biasing means, and (g) a sixth stopper provided on said second link plate, said fourth stopper being abuttable on said sixth stopper to thereby define a maximum movement of said first link plate about said floating shaft against the biasing force of said first biasing means, after said maximum movement of said second link plate is established by abutting contact of said third and fifth stoppers.

10. A feeding apparatus according to claim 8, wherein said pressure-nip release mechanism includes a cam-type pressure-nip release mechanism which comprises a cam having an operating surface, and at least one of said pair of advancing rolls is formed with an extension shaft which extends coaxially with said at least one of the advancing rolls, said cam of said cam-type pressure-nip release mechanism being movable such that said operating surface contacts said extension shaft of said at least one advancing roll, to thereby enlarge said clearance between said pair of advancing rolls.

11. A feeding apparatus according to claim 8, wherein said pressure-nip release mechanism includes a sheet-spring type pressure-nip release mechanism which comprises a generally planar spring member as a principal component thereof, said spring member having an intermediate portion at which said spring member is pivotally supported by a stationary shaft which is supported by a stationary member, said spring member further having opposite end portions one of which engages one of said pair of feed rolls, and the other of which engages a cam provided on said stationary member, said cam having an operative position in which said spring member urging said one advancing roll against the other advancing roll, and an inoperative position in which said said spring member maintains said one advancing roll in non-contact relation with s id other advancing roll.

12. A feeding apparatus according to claim 8, further comprising an operator's controlled operating device for operating both of said clearance enlarging mechanism and said pressure-nip release mechanism.

13. A feeding apparatus according to claim 12, further comprising a contact release mechanism for moving said sheet support member and said feed roll away from each other and thereby releasing an operating condition in which said feed roll and said upper surface of said uppermost sheet are engageable with each other, and wherein said operator's controlled operating device is a three-mechanism operating device which operates all of three mechanisms consisting of said contact release mechanism, said clearance enlarging mechanism, and said pressure-nip release mechanism.

14. A feeding apparatus according to claim 13, wherein said three-mechanism operating device includes an operating member which is movable from an original position thereof to a first and a second position thereof, a movement of said operating member from said original position to said first position causing at least said contact release mechanism to operate while maintaining at least said clearance enlarging mechanism inoperative, and a movement of said operating member to said second position causing said three mechanism to operate.

15. A feeding apparatus according to claim 8, wherein said presser member has a lower surface which includes a contact area which is engageable with said upper surface of said uppermost sheet, and a guide area which extends from said contact area rearwardly in a direction opposite to said feeding direction, said guide area being inclined such that a distance between said upper surface of said uppermost sheet and said guide area increases with a distance between said guide area and said contact area in said direction opposite to said feeding direction.

16. A feeding apparatus for feeding cut sheets one after another to a printer in a feeding direction, comprising:

a presser member engageable with an upper surface of an uppermost sheet of a stack of said cut sheets placed on a sheet support member, to thereby press said uppermost sheet toward said support member;

an elastic member disposed adjacent to said presser member and engageable with leading edges of said cut sheets, said elastic member being elastically deformed in said feeding direction according to a force of contact between said elastic member and said leading edges;

a feed roll engageable with said upper surface of said uppermost sheet, at a position rearwardly of said presser member, for exerting an advancing force on said uppermost sheet and thereby delivering said uppermost sheet toward said printer, through a clearance formed between said elastic member and said presser member due to elastic deformation of said elastic member;

a contact release mechanism for moving said feed roll and said sheet support member away from each other and thereby releasing an operating condition in which said feed roll and said upper surface of said uppermost sheet are engageable with each other;

a pair of advancing rolls for advancing said uppermost sheet toward said printer delivered through said clearance, toward said printer, in contact with said upper surface and a lower surface of said uppermost sheet;

said feed roll and at least one of said pair of advancing rolls being movable in synchronization with each other in a direction perpendicular to said feeding direction;

a pressure-nip release mechanism for moving said pair of advancing rolls away from each other and thereby releasing a condition in which said pair of advancing rolls maintain a pressure nip therebetween through which said uppermost sheet passes with said upper and lower surfaces thereof in contact with said pair of advancing rolls; and an operator's controlled operating device for operating both of said contact release mechanism and said pressure-nip release mechanism.

17. A feeding apparatus according to claim 16, wherein said pressure-nip release mechanism includes a cam-type pressure-nip release mechanism which comprises a cam having an operating surface, and at least one of said pair of advancing rolls is formed with an extension shaft which extends coaxially with said at least one of the advancing rolls, said cam of said cam-type pressure-nip release mechanism being movable such that said operating surface contacts said extension shaft of said at least one advancing roll, to thereby enlarge said clearance between said pair of advancing rolls.

18. A feeding apparatus according to claim 16, wherein said pressure-nip release mechanism includes a sheet-spring type pressure-nip release mechanism which comprises a generally planar spring member as a principal component thereof, said spring member having an intermediate portion at which said spring member is pivotally supported by a stationary shaft which is supported by a stationary member, said spring member further having opposite end portions one of which engages one of said pair of feed rolls, and the other of which engages a cam provided on said stationary member, said cam having an operative position in which said spring member urging said one advancing roll against the other advancing roll, and an inoperative position in which said said spring member maintains said one advancing roll in non-contact relation with said other advancing roll.

19. A feeding apparatus according to claim 16, wherein said contact release mechanism includes a cam-type contact release mechanism which includes a cam for moving said feed roll and said medium support member away from each other, and said operating device includes cam-type operating device which operates said pressure-nip release mechanism by utilizing a movement of said cam of said cam-type contact release mechanism.

20. A feeding apparatus for feeding cut sheets one after another to a printer in a feeding direction, comprising:

a presser member engageable with an upper surface of an uppermost sheet of a stack of said cut sheets placed on a sheet support member, to thereby press said uppermost sheet toward said support member;

an elastic member disposed adjacent to said presser member and engageable with leading edges of said cut sheets, said elastic member being elastically deformed in said feeding direction according to a force of contact between said elastic member and said leading edges;

a feed roll engageable with said upper surface of said uppermost sheet, at a position rearwardly of said presser member, for exerting an advancing force on said uppermost sheet and thereby delivering said uppermost sheet toward said printer, through a clearance formed between said elastic and said presser member due to elastic deformation of said elastic member;

a pair of advancing rolls for advancing said uppermost sheet toward said printer delivered through said clearance, toward said printer, in contact with said upper surface and a lower surface of said uppermost sheet; and said feed roll and at least one of said pair of advancing rolls being movable in synchronization with each other in a direction perpendicular to said feeding direction.

21. A feeding apparatus according to claim 20, further comprising a pair of spaced-apart positioning members for positioning said stack of cut sheets on said sheet support member, in a lateral direction perpendicular to said feeding direction, and wherein said feed roll and at least one of said pair of advancing rolls are movable in synchronization with one of said spaced-apart positioning members in said lateral direction.

22. A feeding apparatus for feeding recording media one after another to a printer in a feeding direction comprising:

a presser member engageable with an upper surface of an uppermost recording medium of a stack of said recording media superposed on each other on a medium support member, to thereby press said uppermost recording medium toward said support member, said presser member having a lower surface which includes a contact area which is engageable with said upper surface of said uppermost recording medium and a guide area which extends from said contact area rearwardly in a direction opposite to said feeding direction, said guide area being inclined such that a distance between said upper surface of said uppermost recording medium and said guide area increases with an increase in distance between said guide area and said contact area in said direction opposite to said feeding direction;

an elastic member disposed adjacent to said presser member and engageable with leading edges of said recording media, said elastic member being elastically deformed in said feeding direction according to a force of contact between said elastic member and said leading edges;

a feed roll engageable with said upper surface of said uppermost recording medium, at a position rearwardly of said presser member, for exerting an advancing force on said uppermost recording medium and thereby delivering said uppermost recording medium toward said printer through a clearance formed between said elastic member and said presser member due to elastic deformation of said elastic member; and a clearance enlarging mechanism for enlarging said clearance by moving said presser and elastic members away from each other.

23. A feeding apparatus according to claim 22, wherein said presser member comprises a pair of spaced-apart presser members which are engageable with opposite corner portions at a leading end of said upper surface of said uppermost recording medium, said feed roll exerting said advancing force on said uppermost recording medium so as to deliver said uppermost recording medium through said clearance due to said elastic deformation of said elastic member.

24. A feeding apparatus according to claim 23, wherein said elastic member comprises a pair of spaced-apart elastic members which are disposed adjacent to said pair of spaced-apart presser members, respectively, such that said pair of spaced-apart elastic members are engageable with opposite ends of said leading edges of said recording media.

* * * * *